US012345101B2

(12) United States Patent
Leismer et al.

(10) Patent No.: US 12,345,101 B2
(45) Date of Patent: Jul. 1, 2025

(54) SYSTEM AND METHOD FOR WELL BORE ISOLATION OF A RETRIEVABLE MOTOR ASSEMBLY

(71) Applicant: ACCESSESP UK LIMITED, Great Yarmouth (GB)

(72) Inventors: Dwayne Leismer, Houston, TX (US); Rogelio Cantu, Houston, TX (US)

(73) Assignee: ACCESSESP UK LIMITED, Great Yarmouth (GB)

( * ) Notice: Subject to any disclaimer, the term of this patent is extended or adjusted under 35 U.S.C. 154(b) by 251 days.

(21) Appl. No.: 18/079,810

(22) Filed: Dec. 12, 2022

(65) Prior Publication Data

US 2023/0399896 A1 Dec. 14, 2023

Related U.S. Application Data

(62) Division of application No. 15/203,011, filed on Jul. 6, 2016, now Pat. No. 11,525,311.

(60) Provisional application No. 62/327,321, filed on Apr. 25, 2016.

(51) Int. Cl.

| | |
|---|---|
| ***E21B 17/02*** | (2006.01) |
| ***E21B 34/06*** | (2006.01) |
| ***E21B 41/00*** | (2006.01) |
| ***E21B 43/12*** | (2006.01) |

(52) U.S. Cl.

CPC ..... *E21B 17/028* (2013.01); *E21B 34/066* (2013.01); *E21B 41/0085* (2013.01); *E21B 43/128* (2013.01); *E21B 2200/06* (2020.05)

(58) Field of Classification Search

CPC .. E21B 17/028; E21B 34/066; E21B 41/0085; E21B 43/128; E21B 2200/06; E21B 34/06

See application file for complete search history.

(56) References Cited

U.S. PATENT DOCUMENTS

| | | | |
|---|---|---|---|
| 4,915,175 | A | 4/1990 | Mashaw, Jr. |
| 4,921,044 | A | 5/1990 | Cooksey |
| 7,950,454 | B2 | 5/2011 | Patel et al. |
| 8,474,520 | B2 | 7/2013 | Martinez et al. |
| 9,051,811 | B2 | 6/2015 | Bussear |
| 9,062,530 | B2 | 6/2015 | Patel et al. |
| 9,238,957 | B2 | 1/2016 | Thurman |

(Continued)

OTHER PUBLICATIONS

J&J Technical Services LLC—2.5 Select-Jet Hydraulic Jet Pump brochure, 2014, 2 pages.

*Primary Examiner* — Brad Harcourt

(57) ABSTRACT

A system and method for hydraulic isolation of a downhole powered system. The system and method include a sliding sleeve, venting assemblies with venting ports, and check valves associated with a vent body, and an isolation sleeve, isolation valve, and integral packer for controlling fluid flow through the motor and pump assembly of the powered system. Also disclosed is a wet connect mandrel modified to receive the isolation sleeve, the isolation sleeve preferably capable of permitting the passage of tools therethrough and capable of preventing fluid through the inlet of the mandrel. The mandrel may also be outfitted with a built-in sliding sleeve. The sleeves, valves and packer can be actuated mechanically, hydraulically or electrically. Electrical actuation can be facilitated using the power from an adjacent wet connect mandrel.

4 Claims, 14 Drawing Sheets

(56) References Cited

U.S. PATENT DOCUMENTS

| | | | | |
|---|---|---|---|---|
| 9,988,894 | B1 * | 6/2018 | Malone | E21B 43/128 |
| 2011/0011596 | A1 * | 1/2011 | Martinez | E21B 43/128<br>166/372 |
| 2013/0043019 | A1 * | 2/2013 | Hansen | E21B 17/0283<br>166/65.1 |
| 2013/0306316 | A1 | 11/2013 | Patel | |
| 2014/0338922 | A1 * | 11/2014 | Lopez | E21B 34/066<br>166/373 |

* cited by examiner

SYSTEM AND METHOD FOR WELL BORE ISOLATION OF A RETRIEVABLE MOTOR ASSEMBLY

CROSS-REFERENCE TO RELATED APPLICATIONS

This application is a divisional patent application of U.S. application Ser. No. 15/203,011 filed Jul. 6, 2016, Confirmation No. 1173, entitled "System and Me-thod for Well Bore Isolation of a Retrievable Motor Assembly," now U.S. Pat. No. 11,525,311 issuing Dec. 13, 2022, which in turn claims the benefit of the filing date of and priority to U.S. Provisional Application Ser. No. 62/327,321 filed Apr. 25, 2016, Confirmation No. 6018; said applications being incorporated by reference herein in their entireties for all purposes.

STATEMENT REGARDING FEDERALLY SPONSORED RESEARCH OR DEVELOPMENT

Not Applicable.

BACKGROUND OF THE INVENTION

In oil and gas wells and the like from which the production of fluids is desired, a variety of fluid lifting systems are used to pump the fluids to the surface. One such pumping system is an electric submersible pump (ESP) system having a pump and a motor to drive the pump to pressurize and pass fluid through production tubing. The use of retrievable ESP systems is a method of enhanced oil recovery, typically run inside the production tubing such that there is fluid communication between the reservoir, annulus, and the pump inside the production tubing. There are times during the life of the operation that various components of the ESP system must be removed from the borehole for repair, replacement, or reconfiguration. The ESP system may be retrieved from the production tubing using standard intervention methods, saving the cost of rig time, delayed production and allowing for non-rig work overs. However, when the pump and motor are removed there may be uncontrolled fluid communication between the production tubing and reservoir. This could be undesirable, especially in circumstances where well work such as pumping, pressuring, or flowing is required. As such, hydraulic isolation within the production tubing is desired when the motor and pump are not installed.

Additionally, in retrievable ESP systems circumstances can exist where it is desirable to have a way to vent free as from the oil that is being pumped and produced. Typically, gas is allowed to vent by routing the gas through venting ports on the production tubing above the pump inlet that are in fluid communication with the well bore annulus. In some cases, fluid communication from the reservoir through these venting ports must be similarly controlled when the pump and motor are removed by isolating or closing off the ports to prevent uncontrolled gas migration to the surface, and must also be controlled when the motor is installed to prevent undesired gas migration and other fluid communication back into the production timing.

Conventional methods use straddle packers to isolate the wet connect mandrel assembly in order to perform hydraulic or mechanical isolation within the bore. This method requires at least two equipment runs and provides a less desirable flow profile through the inner diameter of the tubing string. Additionally, the use of plugs or valves in the well bore in order to provide tubing to surface isolation introduces additional complexity to the well completion design. Any advance that provides for minimizing intervention and complete isolation would provide a competitive advantage.

BRIEF SUMMARY OF THE INVENTION

In one embodiment, there is disclosed a hydraulic isolation system for a downhole powered device comprising: an isolation sleeve, wherein the isolation sleeve is disposed within a wet connect mandrel; and a vent assembly, wherein the vent assembly comprises a vent body and a sliding sleeve. The vent body has a plurality of vent ports and a check valve disposed within each of the plurality of vent ports. The sliding sleeve is adapted to be electrically, mechanically or hydraulically actuated. This system may be modified to include a wet connection disposed adjacent to the pump to provide electric power to electrically actuate the sliding sleeve. The system may further comprise an isolation valve disposed downhole from the wet connect mandrel. The system may also further comprise an integral packer disposed above the wet connect mandrel. In one embodiment, the isolation valve is adapted to be electrically actuated. In another embodiment, the isolation valve is adapted to be mechanically actuated. In yet another embodiment of the system, the isolation valve is adapted to be hydraulically actuated. Similarly, in certain embodiments, the packer may be adapted to be mechanically, hydraulically or electrically actuated in similar fashion.

There is also disclosed a method of fluid isolation for a downhole powered system comprising the steps of: controlling fluid flow through a vent assembly; preventing fluid flow through a wet connect mandrel; preventing fluid flow from a reservoir into the wet connect mandrel; and controlling fluid flow from the wet connect mandrel into an annulus within a production tubing, wherein the annulus is in fluid communication with the surface. In this method, the step of controlling fluid flow through the vent assembly may further comprise actuating a sliding sleeve within a vent body, and may also further comprise preventing fluid flow to backflow into the vent body. In another embodiment, the step of preventing fluid flow through the wet connect mandrel further comprises disposing an isolation sleeve within the wet connect mandrel, wherein the step of disposing the isolation sleeve may follow removing an inner completion from the wet connect mandrel. The method may further comprise utilizing a check valve to prevent fluid flow into the vent body, wherein the check valve is disposed in a vent port in fluid communication with an inner bore of the vent body. This method may further comprise actuating an isolation valve disposed downhole from the wet connect mandrel and/or actuating an integral packer disposed above the wet connect mandrel.

In another embodiment, there is disclosed a vent assembly for a production tubing comprising: a vent body and a sliding sleeve; wherein the vent body has a plurality of vent ports and a check valve disposed within each of the plurality of vent ports; and wherein the sliding sleeve is adapted to be electrically, mechanically or hydraulically actuated. The check valve may comprise a valve body, a spring, and a valve head. The sliding sleeve may be actuated between an open position and a closed position. The vent assembly may further comprise a plurality of sleeve ports disposed on an outer surface of the sliding sleeve, and wherein each of the plurality of sleeve ports are in fluid communication with an inner bore of the sliding sleeve. In one embodiment, disposing the sliding sleeve in the open position aligns the plurality of sleeve ports in fluid communication with the plurality of vent ports. In another embodiment, disposing the sliding sleeve in the closed position removes the plurality of sleeve ports from fluid communication with the plurality of vent ports. In another embodiment, the check valve actuates according to a gas pressure differential between the sleeve inner bore and a production tubing annulus.

In yet another embodiment, there is disclosed a downhole electrical wet connect mandrel, for use in a production tubing-mounted downhole permanent completion. This wet connect mandrel comprises a wet connect tubular member having an upper connection end and a lower connection end, an outer surface, and an internal bore of a desired internal diameter, the upper and lower wet connect tubular connection ends being connectable to ends of the production tubing to permit axial mounting of the wet connect tubular member as a section of the production tubing in the permanent completion. The mandrel is outfitted with an inlet section located on the wet connect tubular member, the inlet section comprising a zone of one or more perforations through the tubular member, the zone having an upper zone end and a lower zone end, the inlet section capable of permitting the passage of fluid therethrough. An upper sealing section is located on the internal bore between the inlet upper zone end and the wet connect tubular member upper end, the internal bore being smooth in the upper sealing section. A lower sealing section is located on the internal bore between the inlet lower zone end and the wet connect tubular member lower end, the internal bore being smooth in the lower sealing section. This mandrel is further outfitted with an electrical wet connect located on the wet connect tubular proximate the upper connection end or lower connection end, the electrical wet connect capable of receiving a source of power from a surface power cable extending downhole outside of the production tubing, the electrical wet connect capable of interfacing with a downhole device requiring power that is located proximate the wet connect to supply power to the device. The mandrel further comprises a latching mechanism proximate the upper connection end or lower connection end for latching into place within the internal bore an isolation sleeve received into the bore, the isolation sleeve having a tubular body with upper and lower seals on the outer surface capable of forming a seal between the upper seal and the smooth bore in the upper sealing section of the bore and between the lower seal and the smooth bore of the lower sealing section of the bore, the seals being positioned on the isolation sleeve to permit sealing of the inlet section to prevent passage of fluid through the inlet section when the isolation sleeve is present within the wet connect mandrel bore.

The mandrel may be used and configured in a number of ways. For example, the downhole electrical wet connect mandrel can be attached below a retrievable ESP system motor shroud in a downhole completion.

In one embodiment, when the isolation sleeve is mounted within the mandrel bore, the isolation sleeve preferably has a large internal diameter capable of receiving downhole tools therethrough.

In one embodiment, the downhole electrical wet connect in the mandrel is capable of connecting with a retrievable ESP system.

In another embodiment, the downhole electrical wet connect mandrel further comprises an actuatable sliding sleeve capable of moving between a first, closed position forming a seal over the inlet section to prevent passage of fluid through the inlet, and a second, open position permitting passage of fluid through the inlet. In this embodiment, the sliding sleeve is capable of being actuated mechanically, electrically or hydraulically. In one embodiment, the sleeve may be actuated electrically using power supplied by the surface power cable or by the electrical wet connect.

In another embodiment, there is also disclosed a retrievable isolation sleeve for use in isolating fluid flow through a downhole electrical wet connect mandrel inlet used in a production tubing-mounted downhole permanent completion. In this embodiment, the isolation sleeve comprises a tubular sleeve body of a desired length having upper and lower ends; a sleeve outer diameter capable of entering an inner bore of the wet connect mandrel, the wet connect inner bore having a desired internal bore diameter; a sleeve internal bore of a desired diameter extending along the entire length of the tubular sleeve body, the internal sleeve diameter capable of permitting the passage of one or more downhole tools therethrough; a sleeve latching mechanism located at the upper sleeve end for securing into a counterpart latching mechanism collet in the wet connect mandrel; an upper seal proximate and below the latching mechanism for sealing against the inner diameter of the wet connect mandrel above the inlet; and a lower seal proximate the lower end for sealing against the inner diameter of the wet connect mandrel above the inlet.

In one embodiment of the isolation sleeve, the wet connect mandrel inner seals are compression seals capable of sealing against the inner bore of the wet connect mandrel to prevent fluid flow through the inlet. In one embodiment, the isolation sleeve internal bore diameter is 3.1". In one embodiment, the isolation sleeve length is approximately 10'. In one embodiment, the isolation sleeve is pressure rated for 10,000 psi across the seals. The isolation sleeve may be installed within the wet connect mandrel inner bore at the time of the permanent completion, if desired. It can later be removed if a retrievable ESP system is required in which case, the isolation sleeve is removed prior to installation of a retrievable ESP system within the wet connect mandrel inner bore. In one embodiment, the isolation sleeve may be installed mechanically by intervention.

There is also disclosed a method of isolating fluid flow through an inlet in a downhole electrical wet connect mandrel installed in a production tubing-mounted downhole permanent completion. In this method, a downhole electrical wet connect mandrel, such as that described herein, is installed in the permanent completion. A retrievable isolation sleeve, such as that described herein, is lowered down the production tubing and into the internal bore of the wet connect mandrel where it is then latched into place. As installed, the isolation sleeve prevents fluid communication across the mandrel inlet section.

There is also disclosed a downhole electrical wet connect mandrel, for use in a production tubing-mounted downhole permanent completion, comprising a built in actuatable sliding sleeve to isolate fluid communication across the mandrel inlet. This embodiment is similar to the other mandrel embodiment, but does not require the internal smooth bore upper and lower sealing sections, and includes an actuatable sliding sleeve capable of moving between a first, closed position forming a seal over the inlet section to prevent passage of fluid through the inlet, and a second, open position permitting passage of fluid through the inlet. In this embodiment, the bore diameter of the wet connect tubular member is sufficient to permit the passage of a retrievable ESP tool or other downhole tool therethrough or within. In this embodiment, the built in, or integral sliding sleeve is capable of being actuated mechanically, electrically or hydraulically. In one embodiment, the sleeve may be actuated electrically using power supplied by the surface power cable or by the electrical wet connect.

In one embodiment of the mandrel having the integral sliding sleeve, the mandrel further comprises an inner concentric sleeve bore along a length of the internal bore of the mandrel that includes the inlet, the concentric sleeve bore having an upper shoulder stop and a lower shoulder stop. In this embodiment, the sliding sleeve further comprises a tubular sleeve segment located within the concentric sleeve bore and having an outer surface in sliding arrangement with the concentric sleeve bore, an upper end and a lower end defining a length sufficient to cover the inlet upper and lower zones; an upper concentric seal located on the outer surface proximate the upper end of the sleeve; and a lower concentric seal located on the outer surface proximate the lower end of the sleeve. In this embodiment, the sliding sleeve is capable of being moved within the concentric sleeve bore between the upper and lower concentric sleeve bore stops. When the sliding sleeve is in its open position, the sleeve seals are located within the concentric sleeve bore below the inlet perforation zone to permit passage of fluid through the inlet; and when the sliding sleeve is in its closed position, the inlet perforation zone is located between the upper and lower sleeve seals to form a seal over the inlet section to prevent passage of fluid through the inlet.

There is further disclosed herein a vent assembly for use in downhole production tubing having a production tubing inner bore disposed about a longitudinal axis, comprising a main tubular body having an upper end, a lower end, an outer surface, and an inner surface defining an inner bore centered about a vent longitudinal axis, the upper and lower ends configured to be connected to ends of production tubing to permit installation of the vent assembly within the production tubing about the production tubing longitudinal axis. This vent assembly further comprises an inner concentric vent sleeve bore located along a length of the inner bore of the tubular body, the vent sleeve bore having an upper shoulder stop and a lower shoulder stop; one or more venting ports disposed through the tubular body along respective one or more vent port axes at angles relative to the vent longitudinal axis to permit fluid communication between the inner bore and an area outside of the tubular body, each of the one or more venting ports comprising a vent bore having an outer opening on the tubular body outer surface and an inner opening on the tubular body inner surface within the vent sleeve bore; an upper concentric seal located on the tubular body inner surface within the vent sleeve bore above and proximate the one or more venting port inner openings; and a lower concentric seal located on the tubular body inner surface within the vent sleeve bore below and proximate the one or more venting port inner openings.

A tubular sliding sleeve is disposed within the vent sleeve bore, the sleeve comprising: an outer surface in sliding arrangement with the vent sleeve bore; an upper sleeve end and a lower sleeve end defining a length; and one or more sleeve venting ports disposed through the tubular sleeve. The sleeve is capable of being moved within the vent sleeve bore between a first closed position against the upper stop and a second open position against the lower stop. When the sleeve is in its second, or open, position against the lower stop, one or more of the one or more sleeve venting ports are aligned with one or more of the one or more tubular body venting ports to permit fluid communication between the inner bore and the area outside of the tubular body. When the sleeve is in its first, or closed, position against the upper stop, none of the one or more sleeve venting ports are aligned with any of the one or more tubular body venting ports, and the upper and lower concentric seals prevent fluid communication between the inner bore and the area outside of the tubular body. An actuator mechanism is provided capable of moving the sliding sleeve between its first and second positions.

The sliding sleeve of the vent assembly may be adapted to be actuated mechanically, electrically or hydraulically. In one embodiment, the vent assembly sliding sleeve is adapted to be actuated electrically using power supplied by a surface power cable. In another embodiment, the vent assembly sliding sleeve is adapted to be actuated electrically using power supplied by an electrical wet connect.

In one embodiment of the vent assembly, the tubular body venting ports are disposed at angles ranging from 30° to 90° relative to the vent longitudinal axis. In some embodiments, each of the tubular body venting ports are disposed at that same angle. In some embodiments, the tubular body venting ports are disposed at an upward angle ranging from 30° to 90° relative to the vent longitudinal axis. These tubular body venting ports may be disposed about the vent longitudinal axis, in spaced-apart fashion in a circumferential straight line.

In some embodiments, the vent assembly further comprises a check valve assembly disposed within each of the one or more tubular body venting ports. In certain embodiments, the check valve assembly comprises an upper vent bore section of a first diameter, the upper vent bore section having a first end defined by the outer opening on the tubular body, and a second end; a lower vent bore section of a second diameter smaller than the upper bore first diameter, the lower vent bore section having a first end joined to the upper vent bore second end, and a second end defined by the inner opening on the tubular body in the vent sleeve bore; a seat sealing area defined as the junction where the upper vent bore is joined with the lower vent bore, the seat sealing area further comprising a seat sealing surface profile; a sealing body located within the upper vent bore section proximate the seat sealing area and having a third diameter less than the upper vent bore first diameter and greater than the lower vent bore second diameter, the sealing body having a surface profile capable of mating with the seat sealing surface profile; and a retaining mechanism located within the upper vent bore section between the outer opening on the tubular body and the seat sealing area, the retaining mechanism configured to retain the sealing body between the retaining mechanism and the seat sealing area while also permitting passage of fluids past the retaining mechanism and sealing body when the sealing body is moved up against the retaining member.

In this embodiment, the sealing body is capable of being moved within the upper vent bore section between the seat sealing area and the retaining mechanism in response to fluid flow or fluid pressure. In some embodiments, sealing body is also capable of moving in a first direction up against the sealing area to seat, in sealing arrangement, on the seat sealing area in response to sufficient fluid pressure being exerted into the venting port from outside of the tubular body, and the sealing body is capable of moving in a second direction opposite the first direction up against the retaining mechanism in response to sufficient fluid pressure being exerted into the venting port from the inner bore.

In certain embodiments of the vent assembly, the retaining mechanism comprises a retaining ring structure having an outer substantially circumferential edge and an inner edge, one or more tabs radially extending inwardly from the inner edge, and one or more fluid flow areas proximate the one or more tabs and the inner edge, the one or more tabs serving to stop movement of the sealing body when the sealing body moves against the retaining mechanism, and wherein fluid flow is permitted across the retaining member through the one or more fluid flow areas and past the sealing body when the sealing body is moved against the tabs in response to fluid flow or fluid pressure. In this embodiment, the retaining ring structure may be generally C-shaped, as modified by the inwardly extending one or more tabs, and the ring structure may be disposed within a slot located in the upper vent bore. In other embodiments, the retaining ring structure is substantially O-shaped washer structure, as modified by the inwardly extending one or more tabs.

In certain embodiments of the vent assembly, the retaining ring structure is formed as an integral part of a threaded body that is secured into the upper bore via a threaded connection. The seat sealing area may be formed on an inwardly extending shoulder formed where the larger diameter upper bore meets the smaller diameter lower bore. The seat sealing shoulder may comprise a beveled downwardly and inwardly sloped surface creating the seat surface profile capable of mating with the seat sealing surface profile of the sealing body. The sealing body may comprise a bearing ball. The bearing ball may comprise a material selected from the group consisting of metals, ceramics, hard refractory crystalline compounds and composite materials. In one embodiment, the bearing ball comprises silicon carbide.

In other embodiments of the vent assembly, different check valve structures can be used, such as a dart-type check valve. In this embodiment, the retaining mechanism comprises a dart-type check valve retaining body secured within the upper bore via a threaded connection, the body further comprising a front face, a rear face, a central axial bore of a first diameter extending through the retaining body to permit passage of a guide rod for guiding axial movement of the sealing body, a recessed area on the front face for receiving a spring, and one or more flow passages through the retaining body to create fluid communication between the front and rear face of the body. In this embodiment, the sealing body comprises a dart-type sealing body having a base, a head section comprising an outer tapered surface extending downwardly and inwardly from the base to form a sealing surface profile, and a guide rod, having a second diameter smaller than the axial bore first diameter, the guide rod attached at a midpoint of the base and extending upwardly a desired length sufficient to extend into the central axial bore. A spring is mounted in the body recess between the retaining body and the base.

The seat sealing shoulder may comprise a beveled downwardly and inwardly sloped surface formed where the larger diameter upper bore meets the smaller diameter lower bore creating a seat surface profile capable of mating with the sealing surface profile of the sealing body. In this embodiment, the spring is configured to exert a pre-tensioned force against the sealing body base to urge the sealing surface profile into sealing contact with the seat surface profile. The sealing body is capable of being moved into and out of sealing relationship with the seat sealing area in response to fluid flow or fluid pressure. In one embodiment, the sealing body is capable of moving in a first direction up against the sealing area to seat, in sealing arrangement, on the seat sealing area in response to the pre-tensioned spring force and or in response to a sufficient fluid pressure being exerted into the venting port from outside of the tubular body; and is capable of moving in a second direction opposite the first direction off of the seat sealing area in response to sufficient fluid pressure being exerted into the venting port from the inner bore, wherein in such instance, fluid flow is permitted past the sealing surface profile, through the flow passages, and out the outer opening on the tubular body.

As will be understood by those having the benefit of the present disclosure, the head section outer tapered surface may comprise a conical, frustoconical or semispherical shaped sealing surface profile and the seat surface profile comprises a suitably shaped surface capable of receiving the sealing surface profile and forming a seal. In one embodiment, the check valve assembly comprises a valve body, a spring, and a valve head, such as for example, a dart-type valve.

There is also disclosed a vent assembly for use in downhole production tubing, similar to that described herein that employs the check valves described herein, but which does not employ a sliding sleeve. In this embodiment, the vent assembly comprises a main tubular body having an inner bore disposed about a longitudinal axis, the tubular body having an upper end, a lower end, an outer surface, and an inner surface defining an inner bore centered about a vent longitudinal axis, the upper and lower ends configured to be connected to ends of the production tubing to permit installation of the vent assembly within the production tubing about the production tubing longitudinal axis. This venting assembly also comprises one or more venting ports (such as those described herein) disposed through the tubular body along respective one or more vent port axes at angles relative to the vent longitudinal axis to permit fluid communication between the inner bore and an area outside of the tubular body, each of the one or more venting ports comprising a vent bore having an outer opening on the tubular body outer surface and an inner opening on the tubular body inner surface. In this embodiment, a check valve assembly (such as those described herein) is disposed within each of the one or more venting ports.

BRIEF DESCRIPTION OF THE DRAWINGS

For a detailed description of exemplary embodiments, reference will now be made to the accompanying drawings in which:

FIG. 8A shows all items in the open position, and FIG. 8B shows these items in the closed position.

NOTATION AND NOMENCLATURE

Figure 1:
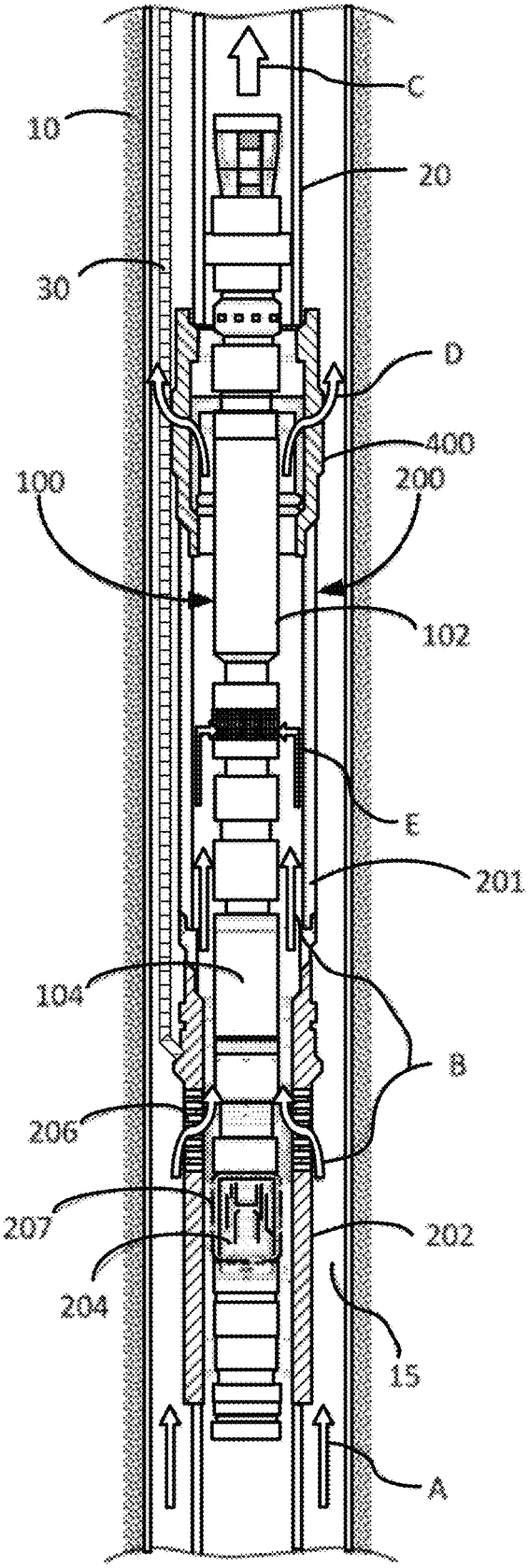
FIG. 1 shows a schematic view or an exemplary retrievable ESP system inside an exemplary permanent completion (shown in sectional view) fitted with a gas venting system in accordance with at least some embodiments all within a borehole or casing (also shown in sectional view).

Certain terms are used, throughout the following description and claims, to refer to particular system components. As one skilled in the art will appreciate, companies that design and manufacture downhole oil and gas related systems may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through in indirect connection via other devices and connections.

Reference to a singular item includes the possibility that there are plural of the same items present. More specifically, as used herein and in the appended claims, the singular forms "a," "an," "said" and "the" include plural references unless the context clearly dictates otherwise. It is further noted that the claims may be drafted to exclude any optional element. As such, this statement serves as antecedent basis for use of such exclusive terminology as "solely," "only" and the like in connection with the recitation of claim elements, or use of a "negative" limitation. Lastly, it is to be appreciated that unless defined otherwise, all technical and scientific terms used herein have the same meaning as commonly understood by one of ordinary skill in the art to which this invention belongs.

Where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail). The referenced items are provided solely for their disclosure prior to the filing date of the present application. Nothing herein is to be construed as an admission that the present invention is not entitled to antedate such material by virtue of prior invention.

DETAILED DESCRIPTION

Before the various embodiments are described in detail, it is to be understood that this invention is not limited to particular variations set forth herein as various changes or modifications may be made, and equivalents may be substituted, without departing from the spirit and scope of the invention. As will be apparent to those of skill in the art upon reading this disclosure, each of the individual embodiments described and illustrated herein has discrete components and features which may be readily separated from or combined with the features of any of the other several embodiments without departing from the scope or spirit of the present invention. In addition, many modifications may be made to adapt a particular situation, material, composition of matter, process, process act(s) or step(s) to the objective(s), spirit or scope of the present invention. All such modifications are intended to be within the scope of the claims made herein.

FIG. 1 illustrates a borehole 10 with a retrievable ESP system 100 including pump 102 and motor 104 and production tubing 20 including a wet connect mandrel (WCM) 202, and gas venting system assembly 400 disposed in borehole 10. Electrical power is supplied to motor 104 from a source external to borehole 10 by way of an ESP power line or cable 30 which terminates near motor 104 at wet connect or wet connection 204. The flow of fluid within the annular space between production tubing 20 and borehole 10 is shown by arrows A, the flow coming into the WCM through inlet or intake 206 flowing around the motor is shown by arrows B, the and the flow of fluid going into the pump 102 is represented by arrow E. Fluid then travels into the pump 102 and up the production tubing 20, and is represented by arrows C. Additionally, gas venting within the illustrated system is shown exiting the pump 102 into the annulus 15 between production tubing 20 and borehole 10 by arrow D.

Figure 2:
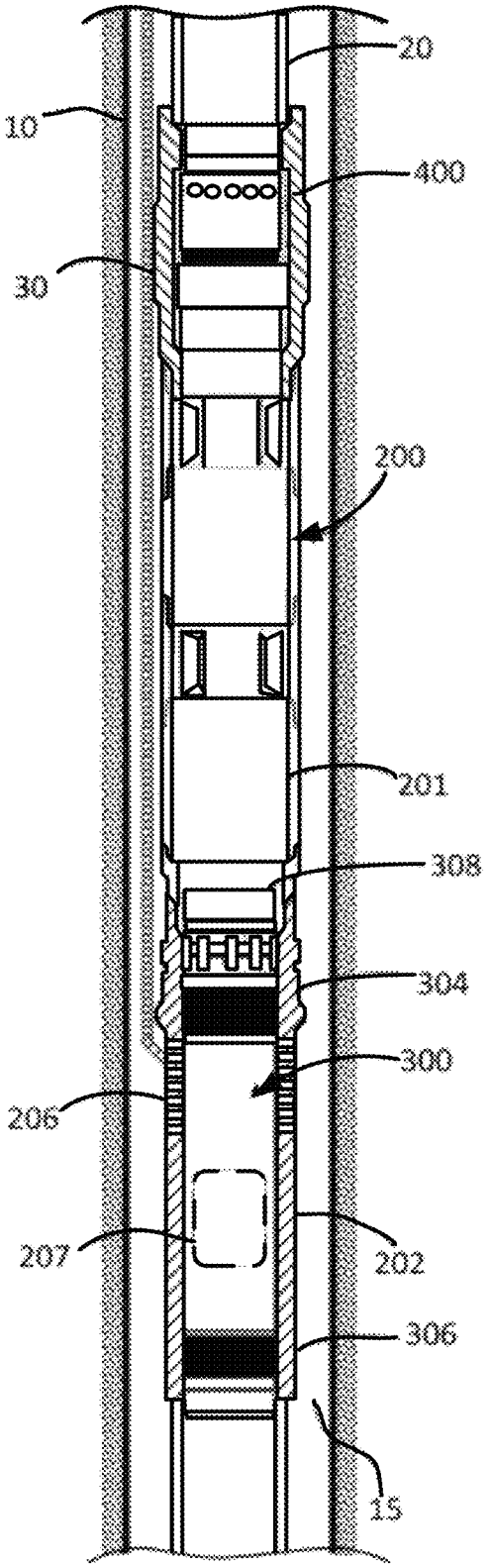
FIG. 2 shows a schematic view of the permanent completion from FIG. 1 with the retrievable ESP system removed, where an exemplary isolation sleeve (shown in plan view) is installed and the gas venting system is shown in its closed position in accordance with at least some embodiments.

Referring now to FIG. 2, production tubing 20 and permanent completion 200 are shown without retrievable ESP system 100. As part of the permanent completion 200, WCM 202 is shown and includes isolation sleeve 300 and gas vent assembly 400. Isolation sleeve 300 is deployed from the surface and into permanent completion 200 through motor shroud 201 such that it is disposed within wet connect mandrel or WCM 202 and positioned to prevent fluid flow into or through inlet 206 and side opening 207 of WCM. Gas vent assembly 400 is disposed above motor shroud 201. In one embodiment, the WCM attaches below a retrievable ESP system motor shroud 201.

Figure 3:
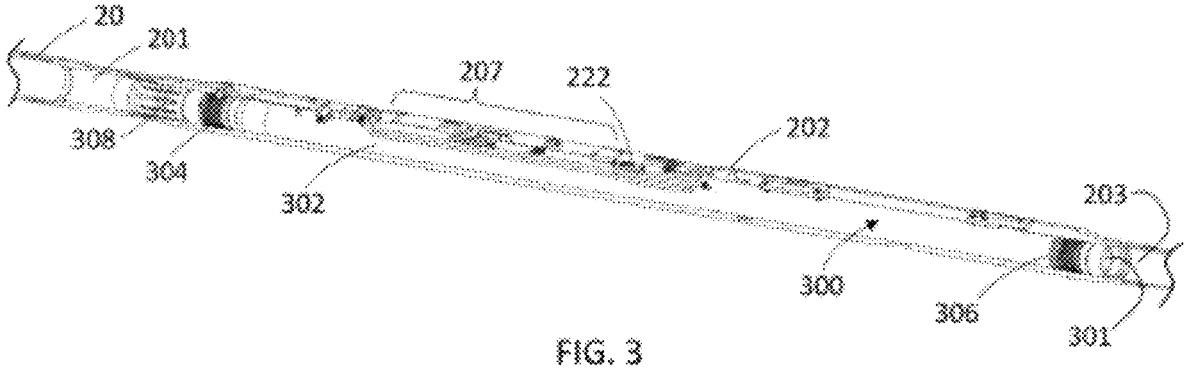
FIG. 3 shows a perspective view of an exemplary isolation sleeve installed inside a wet connect mandrel assembly (shown in sectional view) in accordance with at least some embodiments.
Figure 3A:
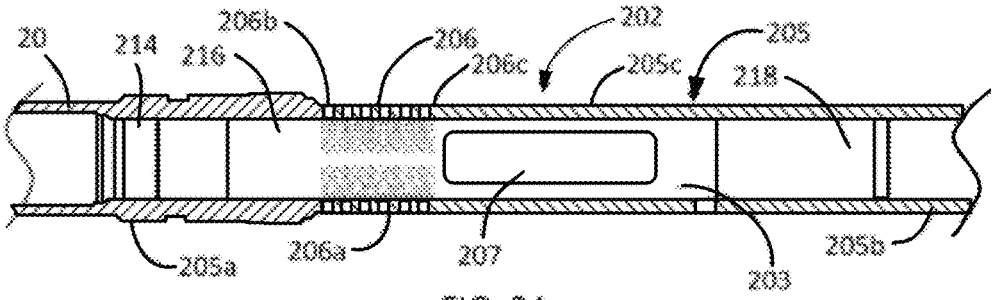
FIG. 3A shows a cross sectional plan view of an exemplary wet connect mandrel assembly in accordance with at least some embodiments.
Figure 3B:
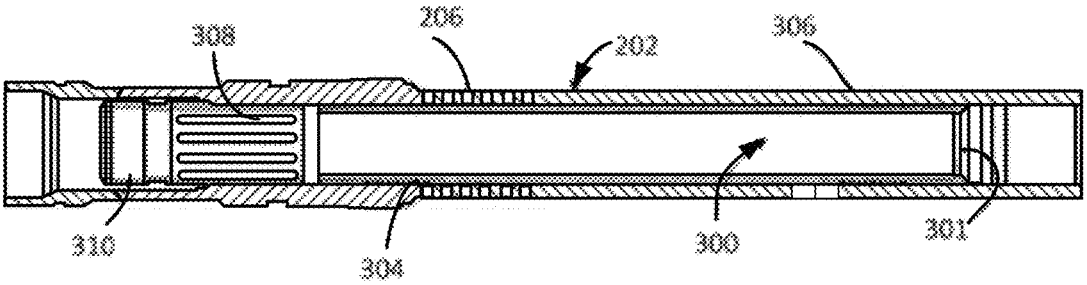
FIG. 3B shows a cross sectional plan view of an exemplary wet connect mandrel assembly shown with an exemplary isolation sleeve latched therein in accordance with at least some embodiments.
Figure 4:
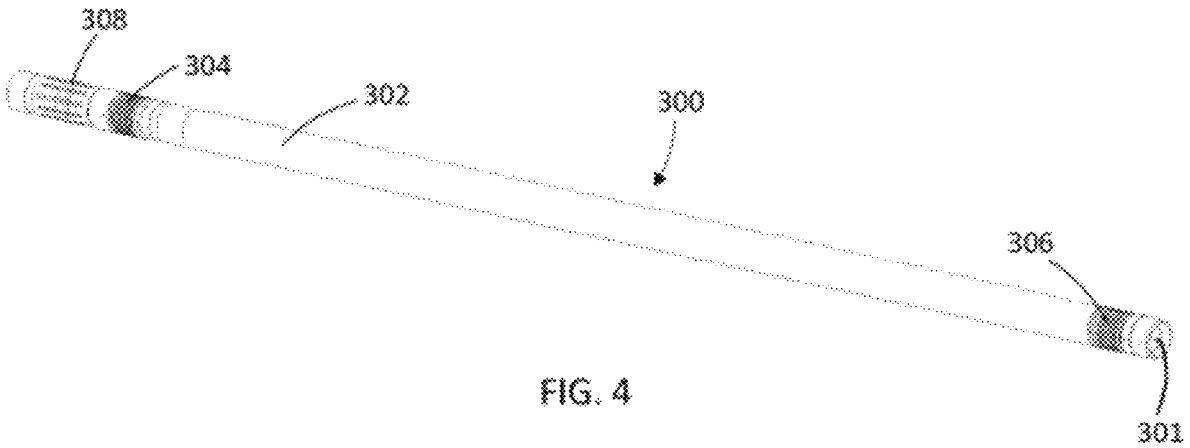
FIG. 4 shows a perspective view of the isolation sleeve assembly of FIG. 3.
Figure 4A:
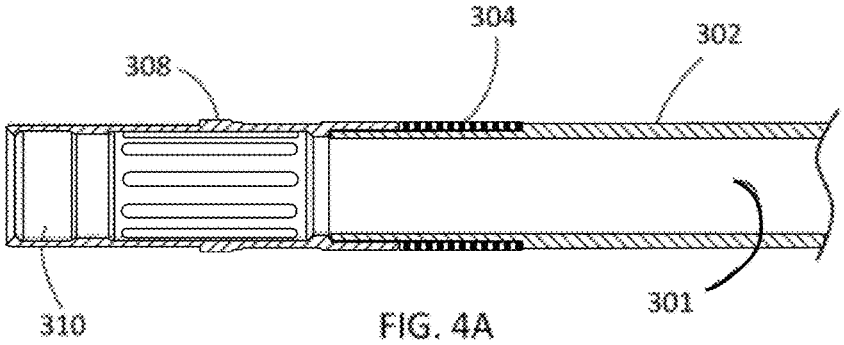
FIG. 4A shows a side cross sectional view of the left end of the sleeve assembly of FIG. 4.

Referring also to FIGS. 3, 3A and 3B, there is shown an exemplary downhole electrical wet connect mandrel WCM 202, for use in a production tubing-mounted downhole permanent completion. In this embodiment, the WCM 202 comprises a wet connect tubular member 205 having an upper connection end 205*a* and a lower connection end 205*b*, an outer surface 205*c*, and an internal bore 203 of a desired internal diameter, the upper and lower wet connect tubular connection ends 205*a*, 205*b* being connectable to ends of the production tubing 20 to permit axial mounting of the wet connect tubular member 202 as a section of the production tubing 20 in the permanent completion 200. The WCM 202 further comprises an inlet or intake section 206 located on the wet connect tubular member 205, the inlet section comprising a zone of one or more perforations 206*a* through the tubular member, the zone having an upper zone end 206*b* and a lower zone end 206*c*, the inlet section capable of permitting the passage of fluid therethrough through the perforations. Referring also to FIGS. 1, 2, 3, 3A and 3B, the WCM 202 also comprises a side opening 207 (see FIGS. 3 and 3A) to permit the second wet connect 204 (FIG. 1) to emerge through the WCM and connect with the first wet connect 202 shown in FIG. 3. The WCM 202 also comprises an upper sealing section 216 located on the internal bore 203 between the inlet upper zone end 206*b* and the wet connect tubular member upper end 205*a*, the internal bore 203 having a smooth, polished finish in the upper sealing section 216. Similarly, the WCM 202 also comprises a lower sealing section 218 located on the internal bore 203 between the inlet lower zone end 206*c* and the wet connect tubular member lower end 205*b*, the internal bore 203 having a smooth, polished finish in the lower sealing section 218. The side opening 207 is located between the upper sealing section 216 and the lower sealing section 218. As will be discussed below, the bore 203 in the sealing sections 216 and 218 preferably has a smooth polished finish to provide an ideal sealing surface for annular seals that may be introduced therein, such as the annular seals 304, 306 on the isolation sleeve 300 discussed herein.

The WCM 202 also comprises a first electrical wet connect 222 located on the wet connect tubular body 205 proximate the upper connection end 205*a* or lower connection end 205*b*. The first electrical wet connect 222 is capable of receiving a source of power from a surface power cable 30 extending downhole (typically outside of the production tubing 20). The electrical wet connect is capable of interfacing with a downhole device requiring power that is located proximate the wet connect to supply power to the device. In some embodiments, the first wet connect 222 is capable of connecting with a retrievable ESP system as is known in the art such as by connecting with second wet connect 204 located on the retrievable ESP system 100 shown in FIG. 1.

The WCM 202 further comprises a latching mechanism or latching profile 214 proximate the upper connection end 205*a* or lower connection end 205*b* for latching into place within the WCM internal bore 203 another tool, such as an isolation sleeve 300 received into the bore 203. The isolation sleeve 300 latching mechanism 308 is capable of latching with the WCM latching profile 214 so that the upper and lower seals 304, 306 on the outer surface of the isolation sleeve are positioned and capable of forming a seal between the upper seal 304 and the smooth bore in the upper sealing section 216 of the bore 203 and between the lower seal 306 and the smooth bore of the lower sealing section 218 of the bore 203, the seals 304, 306 being positioned on the isolation sleeve 300 to permit sealing of the inlet section 206 and the side opening 207 to prevent passage of fluid through the inlet section 206 and the side opening 207 when the isolation sleeve 300 is present and secured within the wet connect mandrel bore 203. The isolation sleeve 300 also contains a fishing profile 310.

As will be discussed in more detail below in connection with FIGS. 8A and 8B, in other embodiments, there is disclosed a wet connect mandrel configured with an integral intake isolation system. In this embodiment, the WCM 208 further comprises an actuatable sliding sleeve capable of moving between a first, closed position forming a seal over the inlet section to prevent passage of fluid through the inlet, and a second, open position permitting passage of fluid through the inlet. In this embodiment, it would not be necessary to use the isolation sleeve 300 to create a seal over the inlet/intake 206 and the side opening 207. In these embodiments, the sliding sleeve can be actuated mechanically, electrically or hydraulically. In one embodiment, the sliding sleeve is actuated electrically using power supplied by the surface power cable, and in another embodiment, the sliding sleeve is actuated electrically using power supplied by the electrical wet connect.

Referring also to FIGS. 3, 3A, 3B, 4 and 4A, isolation sleeve 300 may be deployed and latched into WCM 202 using a latching mechanism 308, such as a collet, and latching profile 214, and allow full working pressure and the largest available inner diameter of inner bore 301 for fluid flow within production tubing 20. Isolation sleeve 300 may be deployed into WCM 202 and may be landed on a tail pipe section connected below WCM 202. For example, in typical configurations the WCM is characterized by an inner bore 203 of a desired inner diameter, for example, in one embodiment having a 4-½" inner diameter. According to certain embodiments, isolation sleeve 300 is characterized by a main tubular body 302 with an inner bore 301 having a 3.1" inner diameter and approximately a length of 10 feet, while being pressure rated for up to 10,000 psi. The configuration of isolation sleeve 300 is in direct contrast to the inner diameter flow profile and pressure ratings of the long and complex straddle devices currently used with industry standard packers for mechanical and hydraulic isolation. Isolation sleeve 300 is deployed within WCM 202 such that inlet 206 and side opening 207 of WCM 202 is obstructed by isolation sleeve 300, which contains a set of opposed seals (upper seal 304 and lower seal 306) to thereby prevent fluid flow from the annulus outside the production tubing 20 into WCM 202. In certain embodiments, isolation sleeve 300 is installed mechanically by intervention. In certain embodiments, the isolation sleeve has a large internal diameter capable of receiving downhole tools therethrough when the isolation sleeve 300 is mounted within the mandrel bore 203.

The retrievable isolation sleeve 300 may be employed for isolating fluid flow through the inlet 206 of a downhole electrical wet connect mandrel 202 used in a production tubing-mounted downhole permanent completion such as illustrated in FIGS. 1-2. In one embodiment, the retrievable isolation sleeve 300 comprises a tubular sleeve body 302 of a desired length having upper and lower ends. The sleeve 300 has a sleeve outer diameter sized to be capable of entering the inner bore 203 of the WCM 202, the wet connect inner bore 203 having a desired internal bore diameter. The sleeve 300 further comprises an internal bore 301 of a desired diameter extending along the entire length of the tubular sleeve body 302, and in some embodiments, the internal sleeve diameter is sized to be capable of permitting the passage of one or more downhole tools therethrough. A sleeve latching mechanism 308 is located at the upper sleeve end for securing into a counterpart latching mechanism collet or latching profile 214 in the wet connect mandrel 202. The sleeve 300 further comprises an upper seal 304 proximate and below the latching mechanism 308 for sealing against the inner bore diameter of the wet connect mandrel above the inlet; and a lower seal 306 proximate the lower end for sealing against the inner diameter of the wet connect mandrel above the inlet. The sleeve 300 may be installed within the wet connect mandrel inner bore 203 at the time of the completion of the permanent completion 200. In other embodiments, the sleeve 300, if previously installed in the WCM is removed prior to installation of a retrievable ESP system 100 within the wet connect mandrel inner bore 203. The sleeve 300 may be installed mechanically by intervention.

The WCM 202 can be used in conjunction with the isolation sleeve 300 in a method of isolating fluid flow through the inlet in the downhole electrical wet connect mandrel installed in a production tubing-mounted downhole permanent completion. In this method, the WCM 202 would be installed as part of the permanent completion. The retrievable isolation sleeve 300 would be lowered into the production tubing 20 and into the internal bore 203 of the wet connect mandrel 202. The sleeve latch mechanism 308 would then be latched to the latching profile 214 of the WCM 202. In so doing, the upper and lower seals 304, 306 of the isolation sleeve 300 are brought into sealing relationship with the respective polished bore surfaces 216, 218 of the WCM present above and below the WCM intake zone 206. Once so installed, the isolation sleeve prevents the passage of fluid through the WCM intake 206, while also permitting the passage of tools down through the production tubing 20 and through the inner bore 301 of the isolation sleeve 300. In one embodiment, the seals 304, 306 on the isolation sleeve form a compression fit seal against the polished bore surfaces 216, 218. In another embodiment, the seals 304, 306 are sized to create an outer diameter slightly larger than the inner diameter of the polished bore sections 216, 218 to create an interference fit seal between the seals and the polished bore surfaces. In yet another embodiment, the polished bore sealing surfaces 216, 218 comprise a slightly raised profile within the WCM bore 203 to create a slightly smaller internal diameter in the polished sections as compared to the remaining internal diameter profile of the WCM bore 203.

Referring now to FIGS. 5A-5G, a gas vent assembly 400 is depicted and includes a lower connection 402, main body 404 (having outer surface 404*a* and inner bore surface 404*b*), upper connection 406, sliding sleeve 408 (having outer surface 408*a* and inner surface 408*b*), and check valve assembly 500. As referenced above, in certain embodiments lower connection 402 couples to the string of the permanent completion 200 directly above a motor shroud 201. The main body 404 is disposed between lower connection 402 and upper connection 406, and is characterized by multiple vent ports 405 disposed through vent body 404. In one embodiment, the vent ports 405 are disposed along respective vent port axes 41 at angles 42 ranging from 30° to 90° to the longitudinal axis 40 of vent body 404, and may be equally spaced around the outer surface 404*a* of vent body 404. The vent ports may each follow the same angle, or could have differing angles. Vent ports 405 are each characterized by an internal opening 407*a* in fluid connection with vent body inner bore 409, and an external opening 407*b* exiting to the outside of the gas venting main tubular body 404. An inner concentric vent sleeve bore 414 is located in the inside surface 404*b* of vent body inner bore 409 along a desired length 410*c* defined by upper and lower shoulders or stops 413*a*, 413*b*. Upper and lower concentric seals 412*a*, 412*b* are disposed in the vent sleeve bore 414 (in body inner surface 414) above and below the vent port internal openings 407*a*. Vent body inner bore 409 is disposed axially through gas vent assembly 400, and is aligned with the longitudinal axis of production tubing 20. Other vent port arrangements will be apparent in view of the teachings herein.

Sliding sleeve 408 is disposed concentrically within the vent body inner bore 409 of gas vent assembly 400 against the upper and lower seals 412*a*, 412*b*, in the vent sleeve bore 414 located in the inside surface 404*b* of vent body 404, and is configured to be actuatable to slide within inner concentric vent bore 414 between an upper stop 413*a* disposed on the inner surface of upper connection 406 (or otherwise at upper end of vent sleeve bore 414) and a lower stop 413*b* disposed on the inner surface of lower connection 402 (or otherwise at lower end of vent sleeve bore 414). Sliding sleeve 408 is characterized by multiple sleeve ports 411 spaced equally through sliding sleeve 408 and configured at a similar orientation to that of vent ports 405 so that when the sleeve 408 is in its upper, or closed position (FIGS. 5A, 5B), the sleeve ports 411 are blocked by the inner wall of body 404 along vent body inner bore 409 above the upper seal 412*a*. When the sleeve 408 is in its lower, or open position (FIGS. 5D, 5E), the sleeve ports 411 are aligned with the vent port internal openings 407*a* in the inner wall of body 404 along vent body inner bore 409 between the upper seal 412*a* and lower seal 412*b* to permit fluid communication from the vent body inner bore 409 through the outer wall 404 of the vent assembly 400. In one embodiment, the outer surface 408*a* of sleeve 40 further comprises a recessed, concentric outer groove 411*a* around the sleeve ports 411.

Figure 5A:
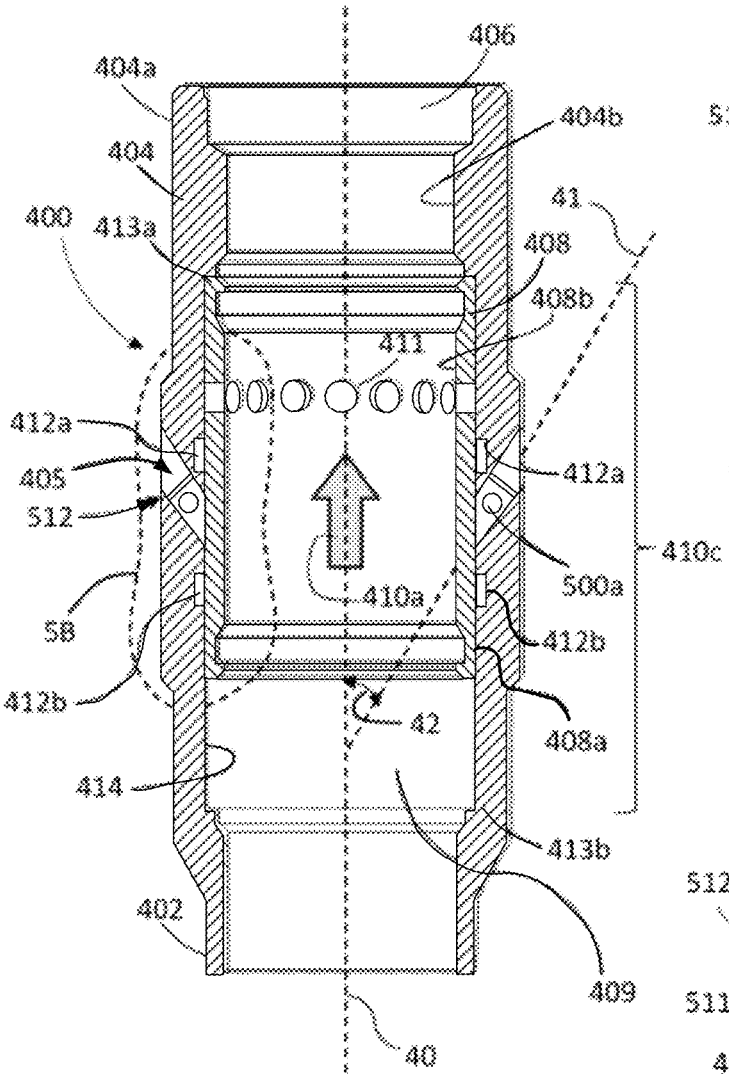
FIG. 5A shows a cross sectional plan view of an exemplary gas venting assembly fitted with a sliding sleeve (shown in the closed position) including check valves in accordance with least some embodiments.
Figure 5B:
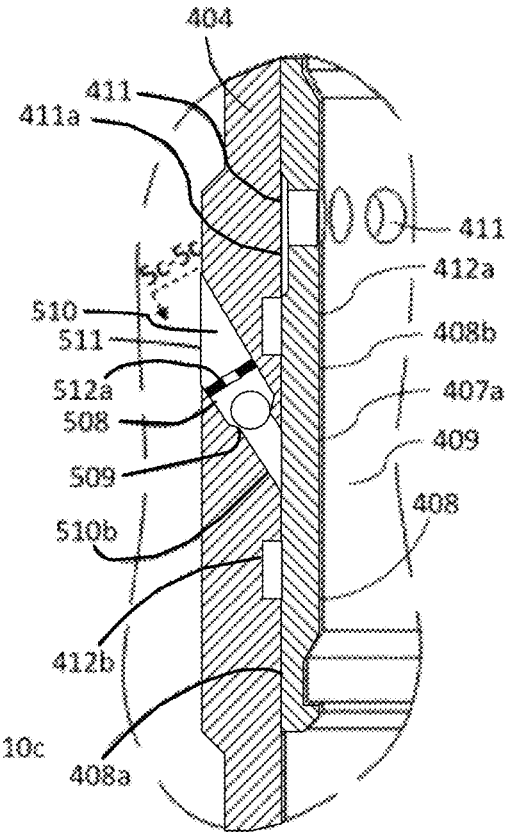
FIG. 5B illustrates the enlarged area labelled 5B in FIG. 5A, depicting a detailed view of the components on the gas venting assembly.
Figure 5C:
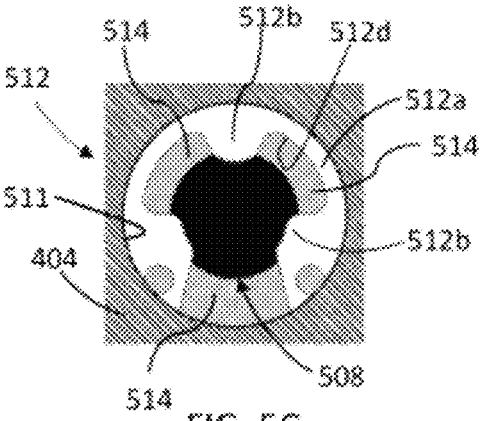
FIG. 5C shows a cross sectional view of the check valve and its flow areas in accordance with at least some embodiments taken along lines 5*c*-5*c* of FIG. 5B.
Figure 5D:
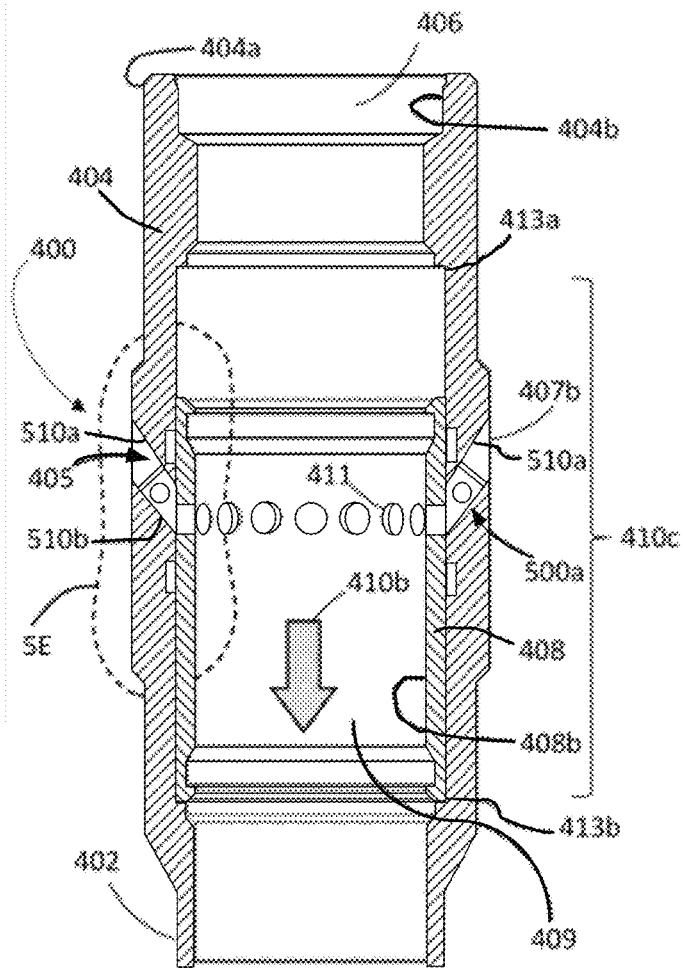
FIG. 5D shows a cross sectional plan view of an exemplary gas venting assembly fitted with a sliding sleeve (shown in the open position) including check valves in accordance with at least some embodiments.
Figure 5E:
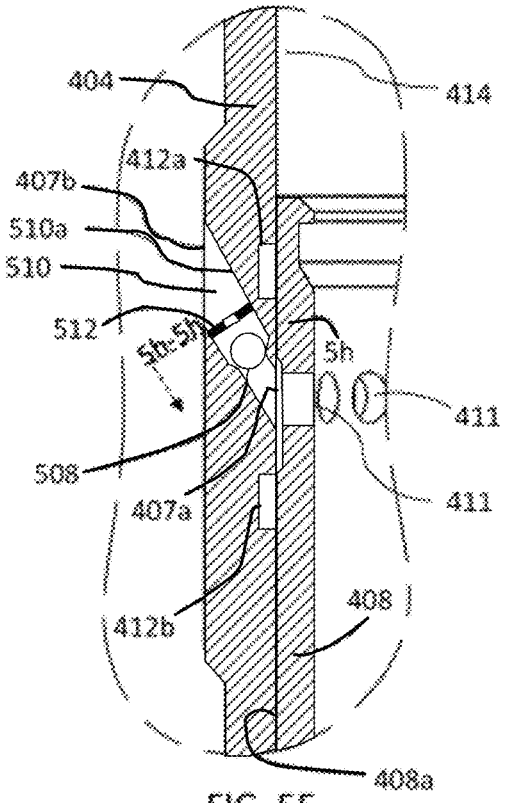
FIG. 5E illustrates the enlarged area labelled 5E in FIG. 3D.
Figure 5H:
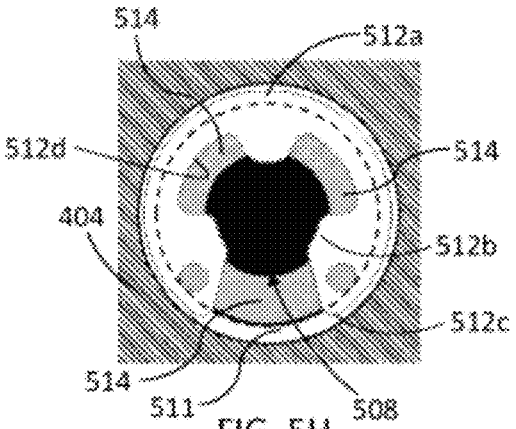
FIG. 5H shows a cross sectional view of the check valve and its flow areas in accordance with at least some embodiments taken across the retainer snap ring along lines 5*h*-5*h* of FIG. 5E.
Figure 5I:
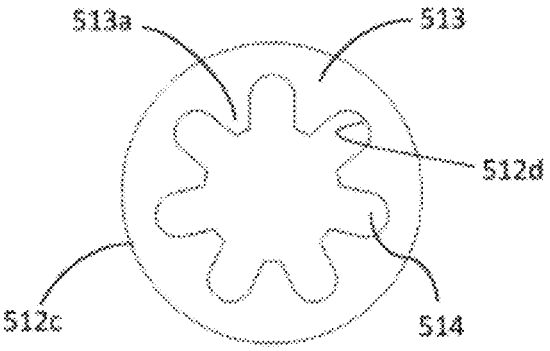
FIG. 5I shows another embodiment of a retaining mechanism for use in various check valve configurations.

According to certain embodiments, sliding sleeve 408 may be shifted, between an upper position (in a first direction as indicated by arrow 410*a* until against stop 413*a*) and a lower position (in a second direction indicated by arrow 410*b* until against stop 413*b*) along motion path 410*c*. In the exemplary embodiment illustrated, when sliding sleeve 408 is disposed in the lower or second position (against stop 413*b*), such as shown in FIG. 5D, sleeve ports 411 and vent port internal openings 407*a* are aligned and positioned such that fluid communication between each of the aligned sleeve ports and vent ports is possible. When sliding sleeve 408 is disposed in the upper or first position (against stop 413*a*), such as in FIG. 5A, the respective sleeve and vent ports are placed out of alignment and the fluid communication between the ports is removed. The sliding sleeve configuration may be equivalently arranged such that the sleeve is shifted to the lower position to close the fluid communication between the ports, and similarly may be shifted to the upper position to place the ports into alignment and thereby permit fluid communication.

Isolation of the vent ports 405 by the sliding sleeve 408 may occur by way of any number of varying actuation methods. In some embodiments, sliding sleeve 408 may be actuated mechanically using a common shifting tool. Alternatively, the sliding sleeve 408 could be also actuated as the inner completion string is retrieved from the ESP system. Alternatively, or in combination, the sliding sleeve 408 may be actuated electrically, taking advantage of the nearby power source provided by the power connection of wet connect 204. Additionally, sliding sleeve 408 may be actuated upon the deployment of isolation sleeve 300 after the inner completion string is removed. Sliding sleeve 408 may also be actuated hydraulically or electrically from surface.

As noted above, the gas vent assembly 400 comprises one or more gas vent ports disposed about the vent assembly body 404. Referring now to FIGS. 5A-5H, 6A-6B, 7, and 10A-10E various check valve assemblies, e.g., 500*a*, 500*b* may be positioned within vent ports 405 to control fluid flow through vent ports 405 from the annulus 15 into the production tubing 20 (into the motor shroud 201).

Referring to FIGS. 5A-5I, and FIG. 7, according to certain embodiments, check valve assembly 500*a* comprises a check valve bore body 510 comprising venting port 405, having a port internal opening 407*a* opening into the gas venting assembly vent body inner bore 409 and a port external opening 407*b* opening to the outside of the gas venting assembly 400. Check valve bore body 510 comprises an upper bore inner wall surface 510*a* defining an upper bore internal diameter, and a lower bore inner wall surface 510*b* defining a lower bore internal diameter, the upper bore having a larger diameter than the lower bore. At the interface between the check valve upper bore and lower bore is a valve seat sealing area 509. A retention structure, 512, is mounted to or in the upper bore body inner wall surface 510*a* to serve as an upper stop for the check valve sealing body 508, here shown as a bearing ball.

The bearing ball 508 is of a diameter larger than the diameter of the lower bore diameter, but smaller than the diameter of the upper bore diameter. This permits the bearing ball 508 to seat, in sealing arrangement, on the valve seat sealing area 509 in response to sufficient fluid pressure being exerted into the venting port 405 from outside of the assembly 400. This also permits the bearing ball 508 to move within the upper bore away from the seat seal 509 in response to sufficient fluid pressure being exerted from the gas venting assembly vent body inner bore 409, in which instance, the bearing ball 508 moves upward within the venting port 405 until it is pushed against the retention structure 512. The retention structure 512 is adapted to retain the bearing ball 508 in response to such fluid pressure (e.g., from gas) coming from the vent body inner bore 409 while also permitting such fluids (e.g., gas) to move through the retention structure and out the port external opening 407*b*.

In one embodiment, the retention structure is a generally C-shaped snap-ring washer 512*a* that snap locks into a retaining ring slot 511 in the upper bore body inner wall surface 510*a*. The snap ring 512*a* generally comprises a ring outer edge 512*c*, a ring inner edge 512*d*, and one or more inwardly extending retention tabs 512*b* capable of stopping the movement of the check valve sealing body (here, a sealing ball) 508. The snap-ring 512*a* further comprises one or more surface feature flow areas 514 to permit fluid (e.g., gas) to flow past the sealing ball 508 when then sealing ball 508 is moved up against the retaining tabs 512*b*. In one embodiment, the flow areas 514 comprise the areas between the tabs 512*a*. In another embodiment, a perforated washer could be used. Other retention structures could be employed that serve to retain the sealing member 508 while also permitting fluid flow past the sealing member and retention structure when the sealing member is moved up against the retention member. For example, referring now to FIG. 5I, there is shown another check valve retention structure 513 comprising a generally O-shaped washer with a plurality of radially inwardly extending tabs 513*a*. The number of tabs 513*a* shown here is seven, but the number and shape of tabs could be varied, the retention structure being configured to retain the sealing member 508 while also permitting passage of fluid (e.g., gas) past the retained sealing member 508.

In one embodiment, the check valve sealing member 508 comprises a bearing ball 508. The bearing ball 508 can be made from any suitable material, such as metal, ceramics and composite materials. In one embodiment, the bearing ball 508 is made from silicon carbide or carborundum. It is preferable that the movement of the bearing seal (bearing ball) 508 be activatable at the lowest possible pressure, and be resistant to erosion. As such, a bearing ball 508 comprising silicon carbide provides lower weight and less density than metal (steel) bearings, less erosion, and a lower cracking pressure. The use of silicon carbide bearing balls as the check valve sealing member is also particularly useful where the gas venting assembly 400 is located in a horizontal or deviated orientation. In such orientation, the check valve more easily closes.

Referring now also to FIGS. 6A-6E and 10A-10E, according to certain embodiments, another exemplary check valve assembly 500*b* is disclosed. In this embodiment, the check valve is spring actuated dart type check valve. Here, check valve assembly 500*b* includes dart type valve body 502, spring 504, and valve head 506. In this embodiment, the valve head 506 is secured into the check valve bore body 510 via a threaded connection, such as a threaded cap.

Still referring to FIGS. 6A-6E, check valve assembly 500*b* is configured as a dart-style check valve assembly. In this embodiment, as is understood with respect to the operation of dart-style check valves, the check valve assembly 500*b* generally comprises a sealing body 502, a retaining member 506 threaded or otherwise secured into the upper bore body inner wall surface 510*a*, and a spring 504 between the sealing body 502 and the retaining member 506. In this embodiment, the retaining mechanism 500*b* comprises a dart-type check valve retaining body 506 secured within the upper bore 510*a* via a threaded connection or other suitable mechanism for securing the check valve assembly within the bore. The retaining body 506 further comprises a front face 506*a*, a rear face 506*b*, a recessed area 506*c* on the front face 506*a* extended within the body 506 for receiving a spring 504, a central axial bore 506*d* of a first diameter extending through the retaining body 506 to permit passage of a guide rod 502*c* for guiding axial movement of the sealing body 502, and one or more flow passages 506*e* through the retaining body 506 to create fluid communication between the front and rear faces 506*a*, 506*b* of the body 506.

In this embodiment, the sealing body comprises a dart-type sealing body 502 having a base 502*a*, a head section 502*b* comprising an outer tapered surface 502*c* extending downwardly and inwardly from the base 502*a* to form a sealing surface profile 502*c*, and a guide rod 502*d*, having a second diameter smaller than the axial bore first diameter, the guide rod 502*d* attached at a midpoint of the base 502*a* and extending upwardly a desired length sufficient to extend into the central axial bore 506*d*. The shape of the outer tapered surface 502*c* could comprise conical, frustoconical, semispherical or other shapes capable of mating with the seat sealing area 509 having a compatible surface profile shape to form a seal.

A spring 504 is mounted in the body recess 506*c* between the retaining body 506 and the base 502*a*. In this embodiment, the seat sealing shoulder 509 comprises a beveled downwardly and inwardly sloped surface formed where the larger diameter upper bore 510*a* meets the smaller diameter lower bore 510*b* creating a seat surface profile 509 capable of mating with the sealing surface profile 502*c* of the sealing body 502. The spring 504 is configured to exert a pre-tensioned force against the sealing body base 502*a* to urge the sealing surface profile 502*c* into sealing contact with the seat surface profile 509.

The sealing body 502 is capable of being moved into and out of sealing relationship with the seat sealing area 509 in response to fluid flow or fluid pressure. The sealing body 502 is capable of moving in a first direction up against the sealing area 509 to seat the sealing surface profile 502*c*, in sealing arrangement, on the seat sealing area 509 in response to the pre-tensioned spring 504 force as well as by sufficient fluid pressure being exerted into the venting port 405 from outside of the tubular body 404. The sealing body 502 is also capable of moving in a second direction opposite the first direction off of the seat sealing area 509 in response to sufficient fluid pressure being exerted into the venting port (through opening 407 from the inner bore, wherein in such instance, fluid flow is permitted past the sealing surface profile 502*c*, through the flow passages 506*e*, and perhaps also through the central axial bore 506*d* past the rod 502*d* and out the outer opening 407*b* on the tubular body 404.

Figure 5F:
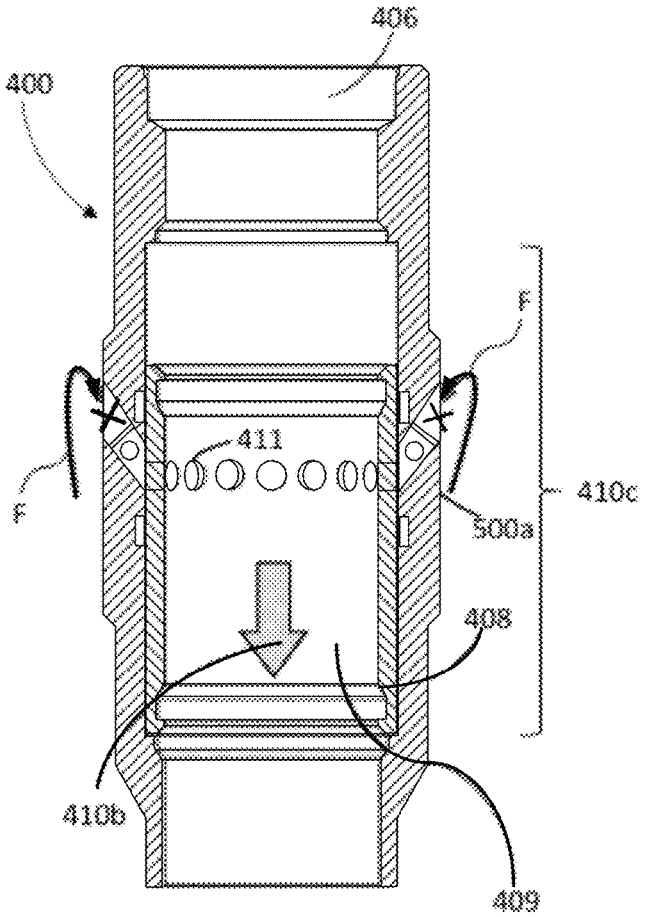
FIG. 5F further illustrates the gas venting system of FIG. 5D with the sleeve shown in the open position, and depicting that the annular flow into the tubing is blocked by the action of the check valves.
Figure 5G:
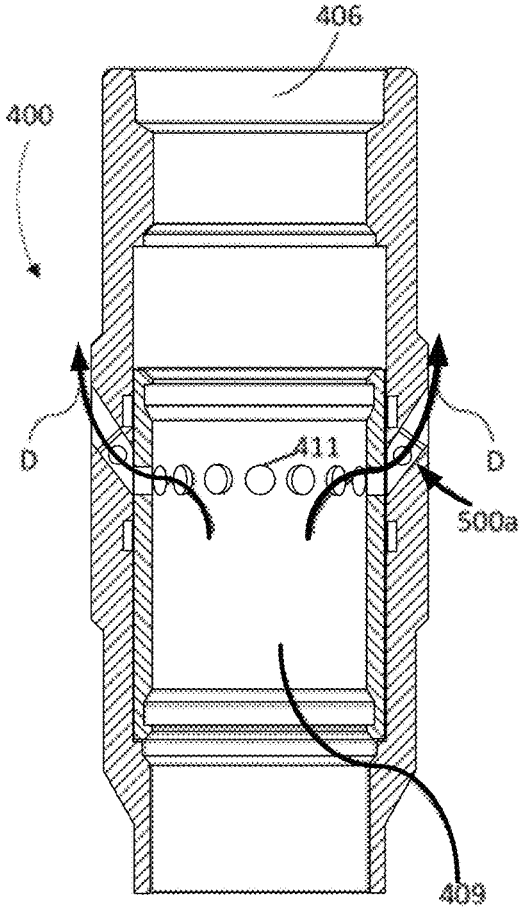
FIG. 5G further illustrates the gas venting system of FIG. 5D with the sleeve shown in the open position, and depicting that the flow from the tubing to the annulus is permitted by the action of the check valves.
Figure 6A:
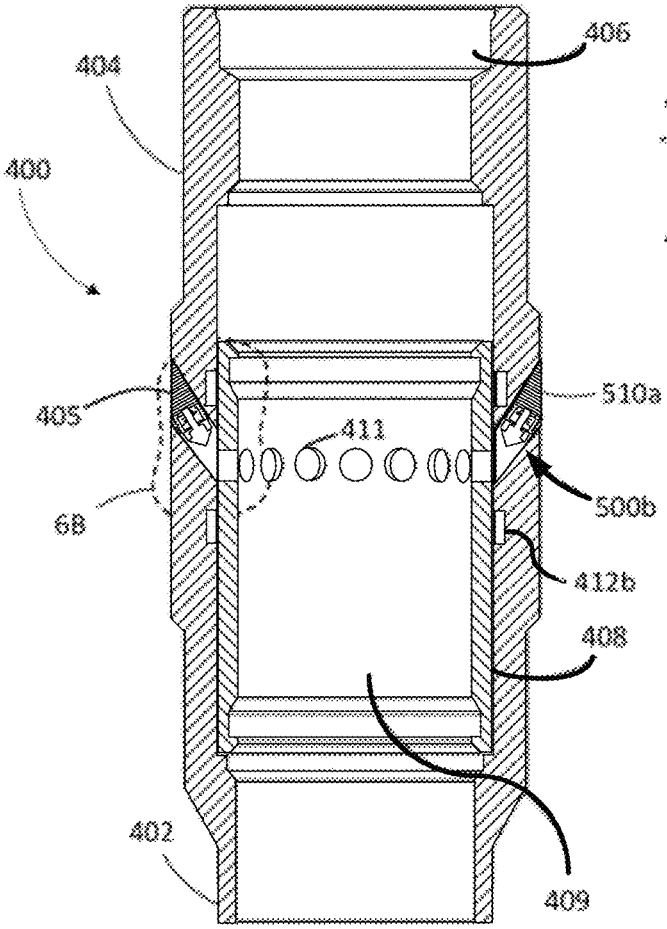
FIG. 6A shows a cross sectional plan view of another exemplary gas venting assembly fitted with a sliding sleeve (shown in the open position) including check valves in accordance with least some additional embodiments.
Figure 6B:
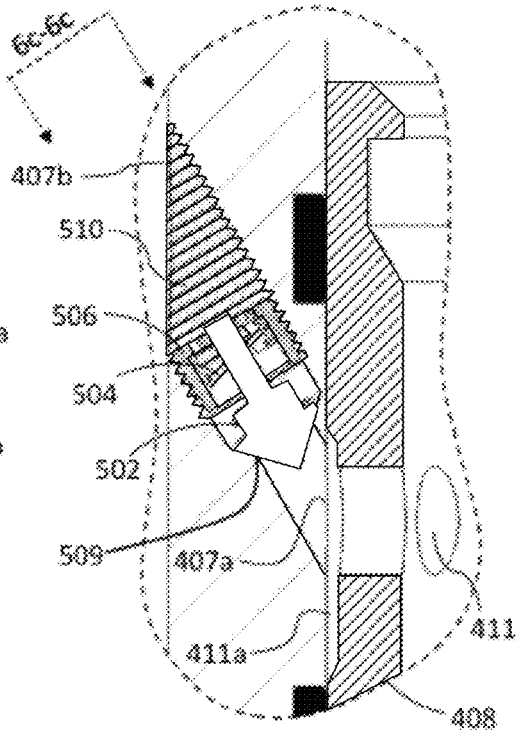
FIG. 6B illustrates the enlarged area labelled 6B in FIG. 6A, depicting a detailed view of the components on the gas venting assembly.
Figure 6C:
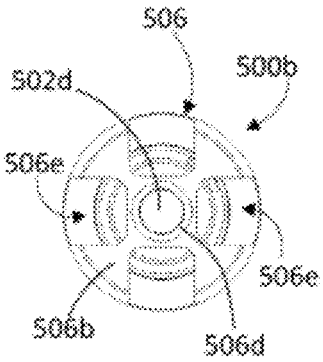
FIG. 6C shows a cross sectional view of the check valve and its flow areas in accordance with at least some embodiments taken across lines 6*c*-6*c* of FIG. 6B.
Figure 6D:
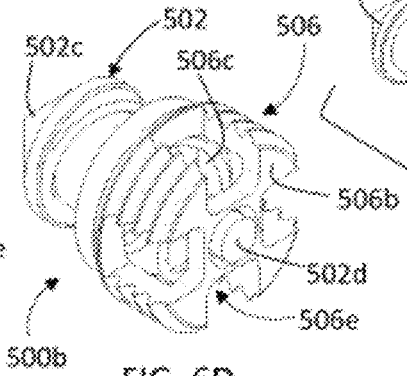
FIG. 6D shows an isometric view of the check valve assembly of FIG. 6B.
Figure 6E:
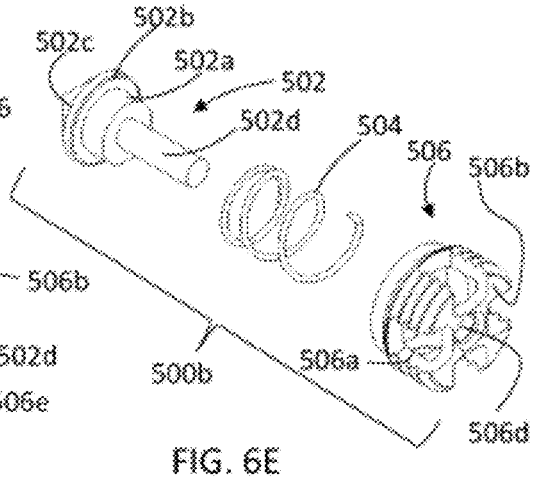
FIG. 6E shows an exploded view of the check valve assembly of FIG. 6D.

Referring now to FIGS. 5F and 5G, operation of the check valves is illustrated. For example, FIG. 5F depicts the gas venting assembly 400 where the sliding sleeve 408 is shown in the open position, and further depicts that the annular flow (arrow F) into the tubing is blocked by the action of the check valves , namely, the pressure from annular flow F forces the sealing number 508 to seal against the check valve seat sealing area 509 to prevent intrusion of annular fluid.

FIG. 5G further illustrates the gas venting system of FIG. 5D with the sleeve shown in the open position, and depicting that the flow from the tubing (arrow D) to the annulus 15 is permitted by the action of the check valves. In this example, the fluid (typically just gas) pressure (arrow D) within the tubing moves the sealing member 508 off of the seat sealing area 509 and up against retainer member 512, and the fluid (gas) can then flow past the retaining member through flow areas 514.

In one embodiment, the preferred angle 42 of each venting port 405 and check valve bore ranges between about 30° to 50° to facilitate the flow of gas out of the tubing.

As will be understood by those having the benefit of the present disclosure, various check valve configurations known in the art or later developed can be employed in accordance with the teachings herein. For example, various check valve assembles could be mounted within the venting bores 405 described herein to achieve the stated check valve purposes while, e.g., being contained solely within the vent assembly outer wall.

The check valve assemblies 500*a*, 500*b* prevent fluid communication through vent ports 405 in circumstances when the gas (or fluid) pressure differential is such that the gas (or fluid) pressure is greater in the annulus 15 than what is found within the motor shroud 201. However, in circumstances when the gas pressure differential is such that the pressure within the motor shroud 201 is greater than that in the annulus 15, check valve assembly 500*a*, 500*b* opens by sliding within vent port 405 to open the fluid communication from vent body inner bore 409 through vent port 405 into the annulus of the production tubing, thereby allowing gas to be vented from within the ESP system.

In certain embodiments, gas vent assembly 400 may not include check valve assemblies and may simply rely on actuation of sliding sleeve 408 for fluid isolation and control.

Figure 7:
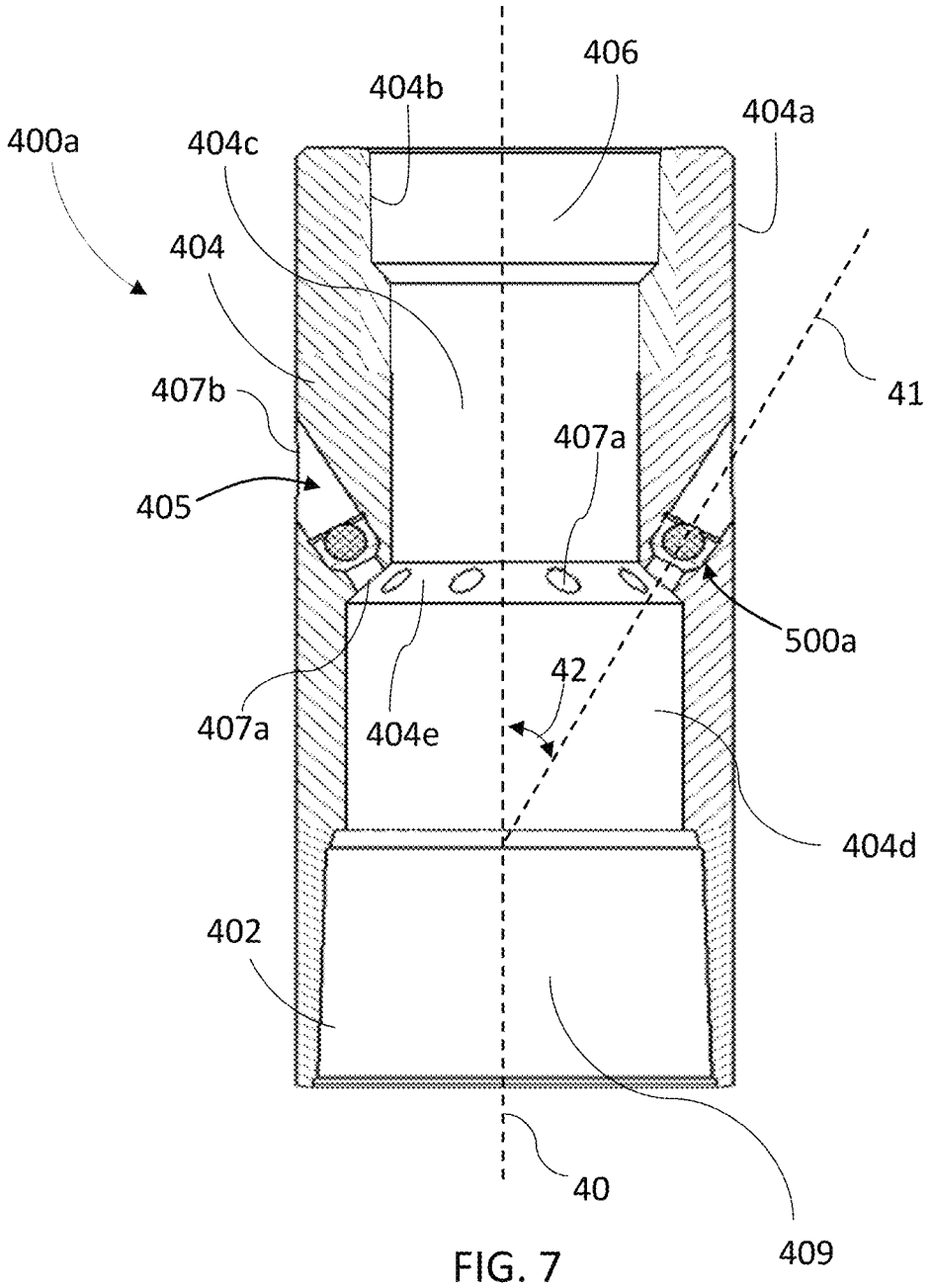
FIG. 7 depicts a cross sectional plan view of an additional exemplary gas venting assembly where no sliding sleeve is present in accordance with at least some embodiments.

FIG. 7 represents yet another embodiment of the gas venting assembly 400*a* featuring no sliding sleeve component. In this configuration, the option of completely isolating tubing from annulus is not available, however, gas venting and prevention of back-flow from annulus to tubing are still present features. Slimmer profiles and lower assembly cost are advantages of this embodiment. More particularly, there is shown a vent assembly 400*a* for use in downhole production tubing, the production tubing having an inner bore disposed about a longitudinal axis. In this embodiment, the vent assembly 400*a* comprises a main tubular body 404 having an upper end, a lower end, an outer surface 404*a*, and an inner surface 404*b* defining an inner bore centered about a vent longitudinal axis 40, the upper and lower ends configured to be connected to ends of the production tubing 20 to permit installation of the vent assembly 400*a* within the production tubing about the production tubing longitudinal axis. One or more, or a plurality of venting ports 405, as described herein are disposed through the tubular body 404 along respective one or more vent port axes 41 at angles 42 relative to the vent longitudinal axis 40 to permit fluid communication between the inner bore 409 and an area outside of the tubular body, each of the one or more venting ports 405 comprising a vent bore having an outer opening 407*b* on the tubular body outer surface 404*a* and an inner opening 407*a* on the tubular body inner surface 404*b*. A check valve assembly 500*a*, 500*b* (as described herein) is disposed within each of the one or more venting ports 405.

In one embodiment, the vent assembly 400*a* further comprises an upper inner bore segment having a first internal diameter and a lower inner bore segment 404*d* having a second internal diameter larger than the first internal diameter. In this embodiment, a junction 404*e* joins the upper and lower inner segments 404*c*, 404*d* as a beveled circumferential shoulder. In this embodiment, each of the inner vent bore openings 407*a* are located on the beveled shoulder 404*e*.

Figure 8A:
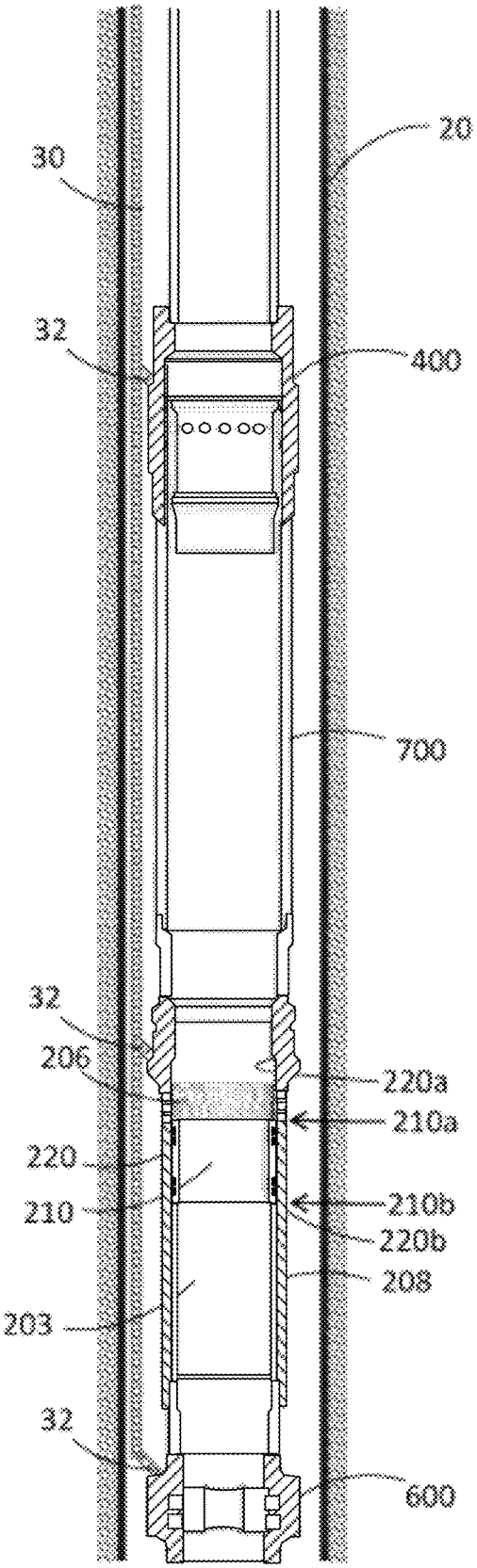
FIGS. 8A and 8B show a schematic of a permanent completion comprising a gas venting sliding sleeve, a wet connect mandrel, and downhole tubular valve, all connected and actuated via the ESP power cable.
Figure 8B:
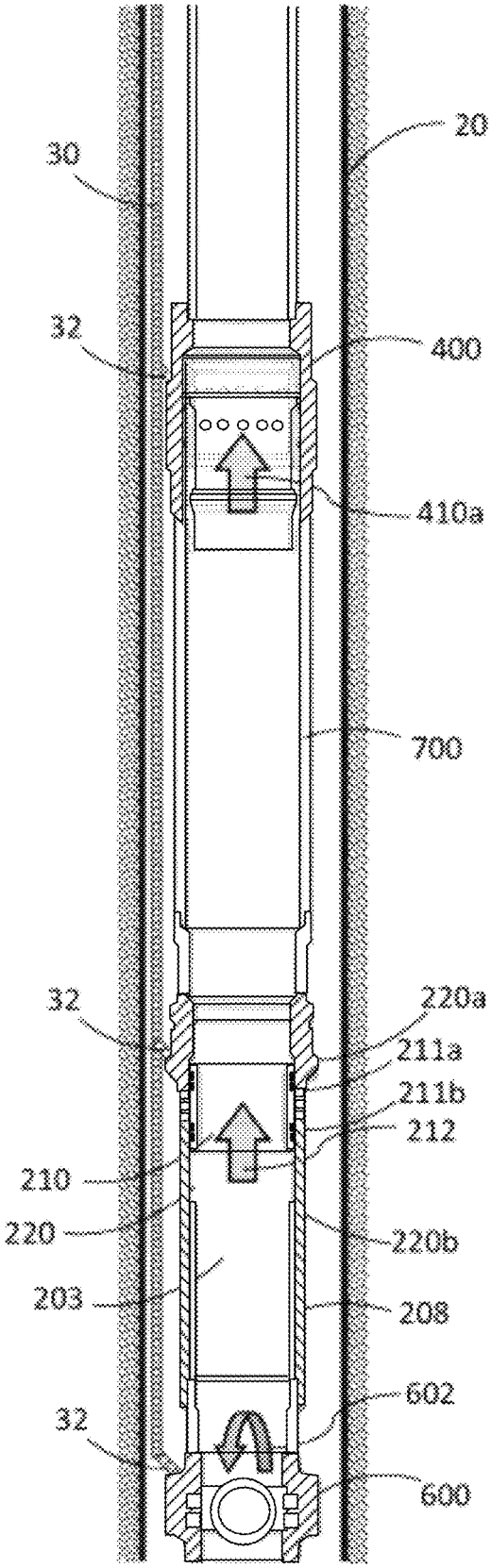

Referring now to FIGS. 8A and 8B, there is depicted, as part of a downhole permanent completion, a downhole electrical wet connect mandrel 208 with integrated intake isolation sleeve 210, for use in a production tubing-mounted downhole permanent completion. Similar to the WCM 202 described in connection with, e.g., FIGS. 1, 2, 3, 3A, and 3B, the modified WCM 208 comprises a wet connect tubular member 205 having an upper connection end 205*a* and a lower connection end 205*b*, an outer surface 205*c*, and an internal bore 203 of a desired internal diameter, the upper and lower wet connect tubular connection ends being connectable to ends of the production tubing 20 to permit axial mounting of the wet connect tubular member 208 as a section of the production tubing 20 in the permanent completion 200. WCM 208 also comprises an inlet or intake section 206 located on the wet connect tubular member 205, the inlet section comprising a zone of one or more perforations 206*a* through the tubular member, the zone having an upper zone end 206*b* and a lower zone end 206*c*, the inlet section capable of permitting the passage of fluid therethrough through the perforations.

An electrical wet connect 222 is located on the wet connect tubular proximate the upper connection end or lower connection end, the electrical wet connect capable of receiving a source of power from a surface power cable 30 extending downhole (typically outside of the production tubing 20), the electrical wet connect capable of interfacing with a downhole device requiring power that is located proximate the wet connect to supply power to the device (such as, for example, a retrievable ESP).

WCM 208 further comprises an actuatable sliding sleeve 210 capable of moving between a first, closed position forming a seal over the inlet section 206 to prevent passage of fluid through the inlet (as illustrated in FIG. 8B), and a second, open position permitting passage of fluid through the inlet 206 (as illustrated in FIG. 8A). In certain embodiments, the inner diameter of the wet connect tubular member bore 203 is sufficient to permit the passage of a retrievable ESP tool or other downhole tool therethrough or within. This WCM sliding sleeve mechanism 210 can be actuated mechanically, electrically or hydraulically. The sliding sleeve can be actuated electrically using power supplied by the surface power cable 20 (via, e.g., power cable lead extensions 32) or the electrical wet connect.

In one embodiment, the downhole electrical wet connect mandrel 208 with integrated isolation sliding sleeve 210 further comprises an inner concentric sleeve bore 220 along a length of the internal bore 203 of the mandrel 208 that includes the inlet/intake 206, the concentric sleeve bore 220 having an upper shoulder stop 220*a* and a lower shoulder stop 220*b*. The inner concentric sleeve bore 220 forms a segment in the internal bore 203 comprising a larger inner diameter within the internal bore 203. The sliding sleeve equipped mandrel 208 further comprises a tubular sliding sleeve segment 210 located within the inner concentric sleeve bore 220 and having an outer surface in sliding arrangement with the inner concentric sleeve bore 220, an upper end 210*a* and a lower end 210*b* defining a sleeve length sufficient to cover the inlet upper and lower zones. Preferably the sleeve ends 210*a*, 210*b* are beveled to facilitate the passage of tools therethrough.

In this embodiment, an upper concentric seal 211*a* is provided located on the sleeve 210 outer surface proximate the upper end 210*a* of the sleeve 210. A lower concentric seal 211*b* is provided located on the sleeve 210 outer surface proximate the lower end 210*b* of the sleeve 210. In this embodiment, the spacing between the upper and lower seals 211*a*, 211*b* is sufficient to cover the inlet 206 when the sleeve 210 is positioned over the inlet 206. In this embodiment, the sliding sleeve 210 is capable of moving within the concentric sleeve bore 220 between the upper and lower concentric sleeve bore stops 220*a*, 220*b*. When the sliding sleeve 210 is in its open position (FIG. 8A), the sleeve seals 211*a*, 211*b* are located within the concentric sleeve bore 220 below the inlet perforation zone 206 to permit passage of fluid through the inlet 206. When the sliding sleeve 210 is in its closed position (FIG. 8B), the inlet perforation zone 206 is located between the upper and lower sleeve seals to form a seal over the inlet section to prevent passage of fluid through the inlet. This WCM sliding sleeve mechanism 210 can be actuated mechanically, electrically or hydraulically. The sliding sleeve can be actuated electrically using power supplied by the surface power cable 20 (via, e.g., power cable lead extensions 32) or the electrical wet connect.

FIGS. 8A and 8B depict a completion shown without the retrievable ESP system 100 in place. In this embodiment, as shown in FIG. 8A, communication between tubing and annulus is open, and this could be undesirable for certain services. In this case, another embodiment of WCM 208 with an integral isolation sleeve 210 is depicted, in addition to a downhole tubing isolation valve 600 below the WCM, and a gas venting sleeve 400 (e.g., as descripted herein) above it. In this embodiment, all three systems are connected to the main ESP power line 30, through lead extensions 32. These extensions provide electrical power to actuate the hydraulic isolating assemblies so that the appropriate barriers (e.g., sliding sleeve in the WCM, sliding sleeve in the gas venting system, and the tubing isolation valve 600) can separate the different flow scenarios.

In FIG. 8B, all three systems are depicted in the closed position. Arrow 410*a* depicts the closing of the gas venting sleeve. Arrow 212 depicts the closing of an integral sleeve via solenoid or other mechanism on the WCM, and arrow 602 depicts the rotation of a ball valve into a closed position. The downhole valve 600 isolates tubing flow, and the sleeves 210 and 400 shut any communication between tubing and annulus.

Figure 9:
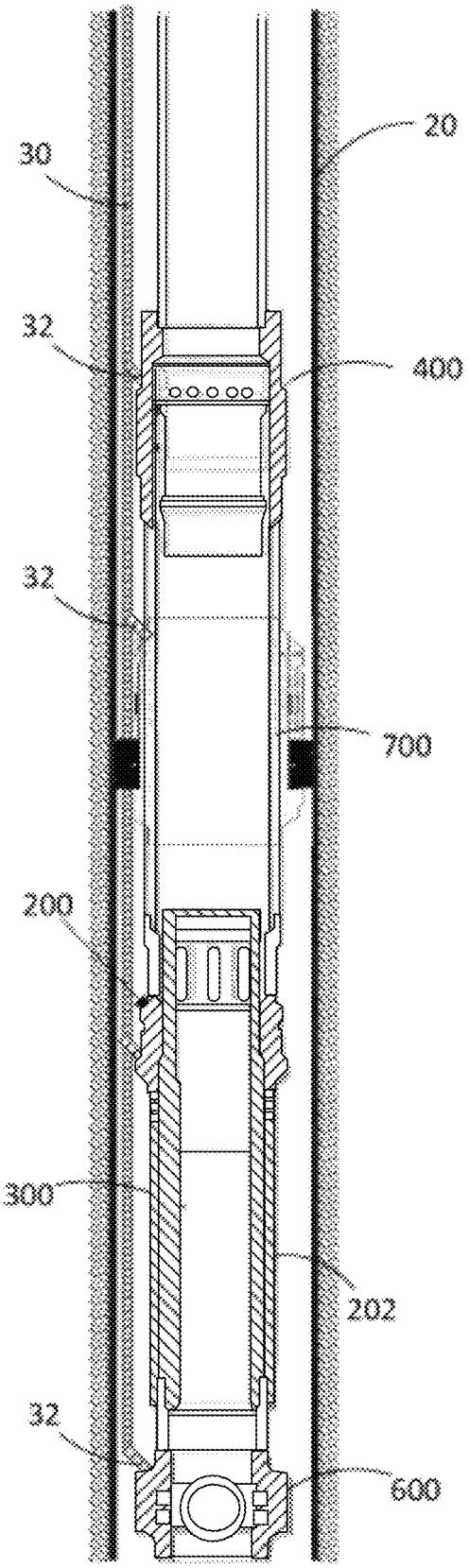
FIG. 9 shows a schematic partial cross-sectional view of a permanent completion comprising a gas venting sliding sleeve, packer, and downhole valve powered by the ESP cable, along with a standard wet connect mandrel with an isolation sleeve.
Figure 10A:
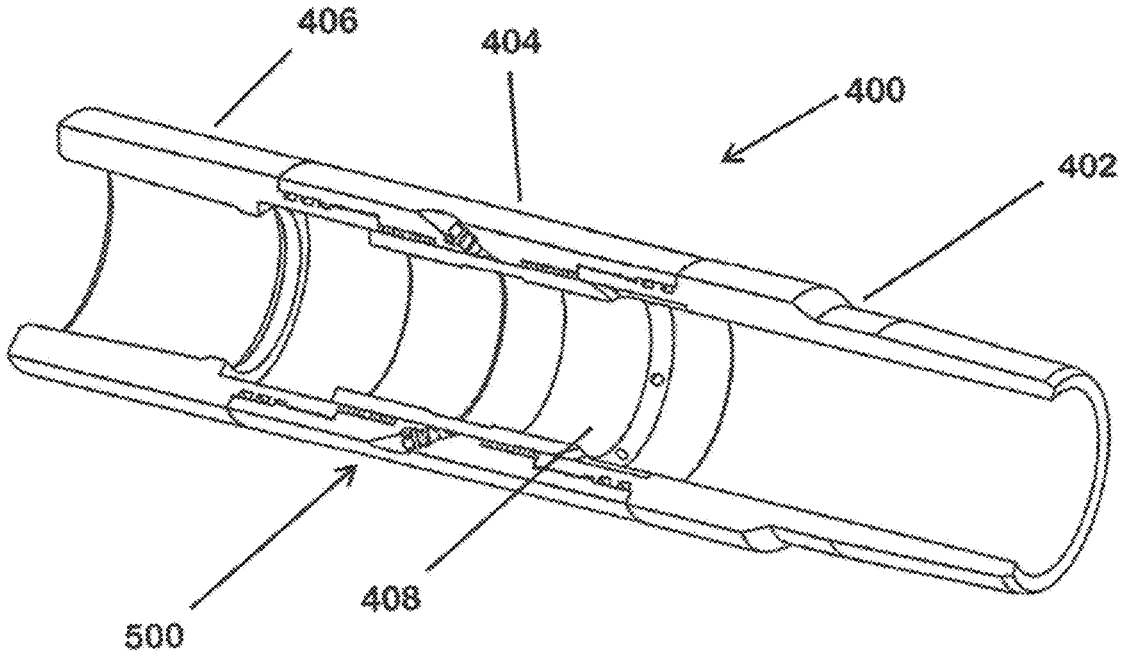
FIGS. 10A, 10B, and 10C show a cross-sectional view of a gas vent assembly in accordance with at least some embodiments.
Figure 10B:
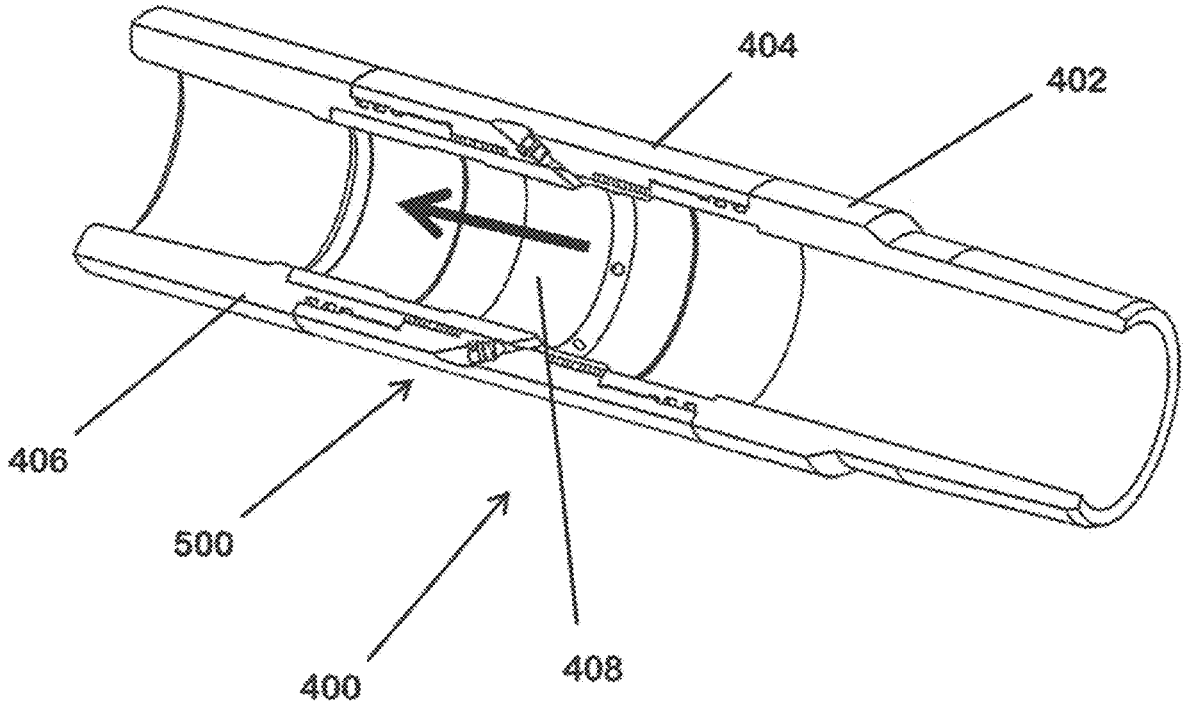
Figure 10C:
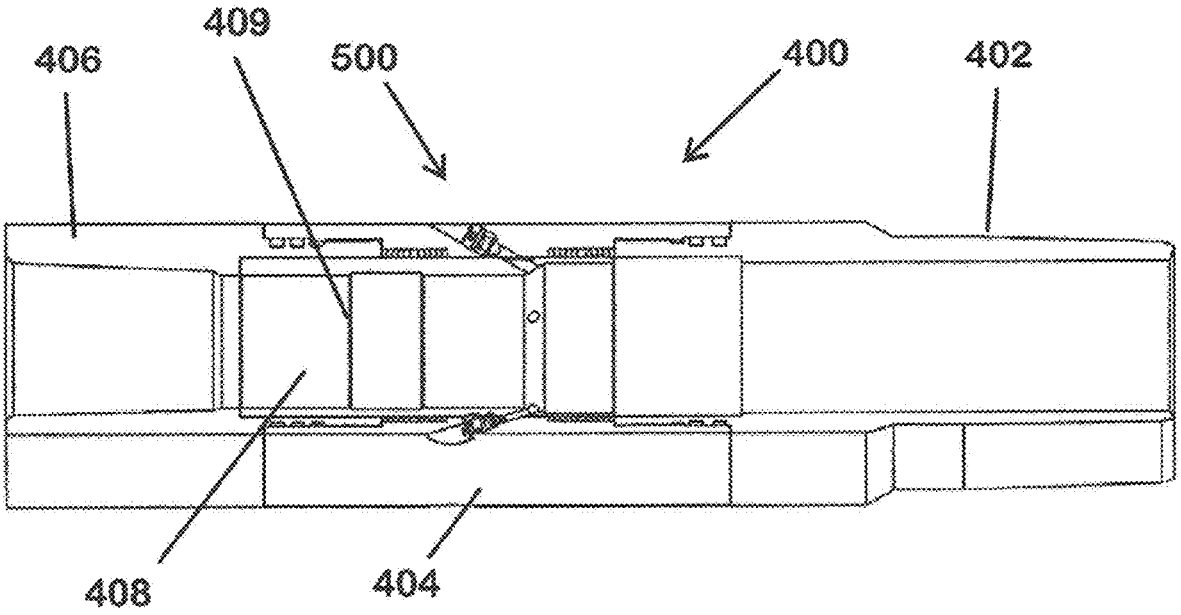
Figure 10D:
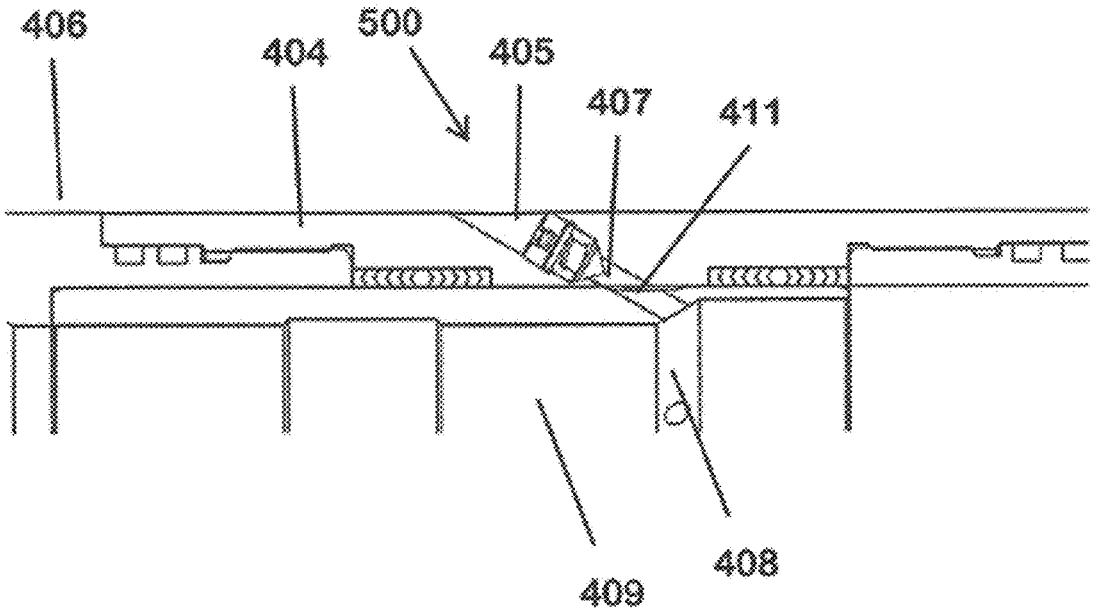
FIGS. 10D and 10E show a cross-sectional view of a gas check valve in accordance with least some embodiments.
Figure 10E:
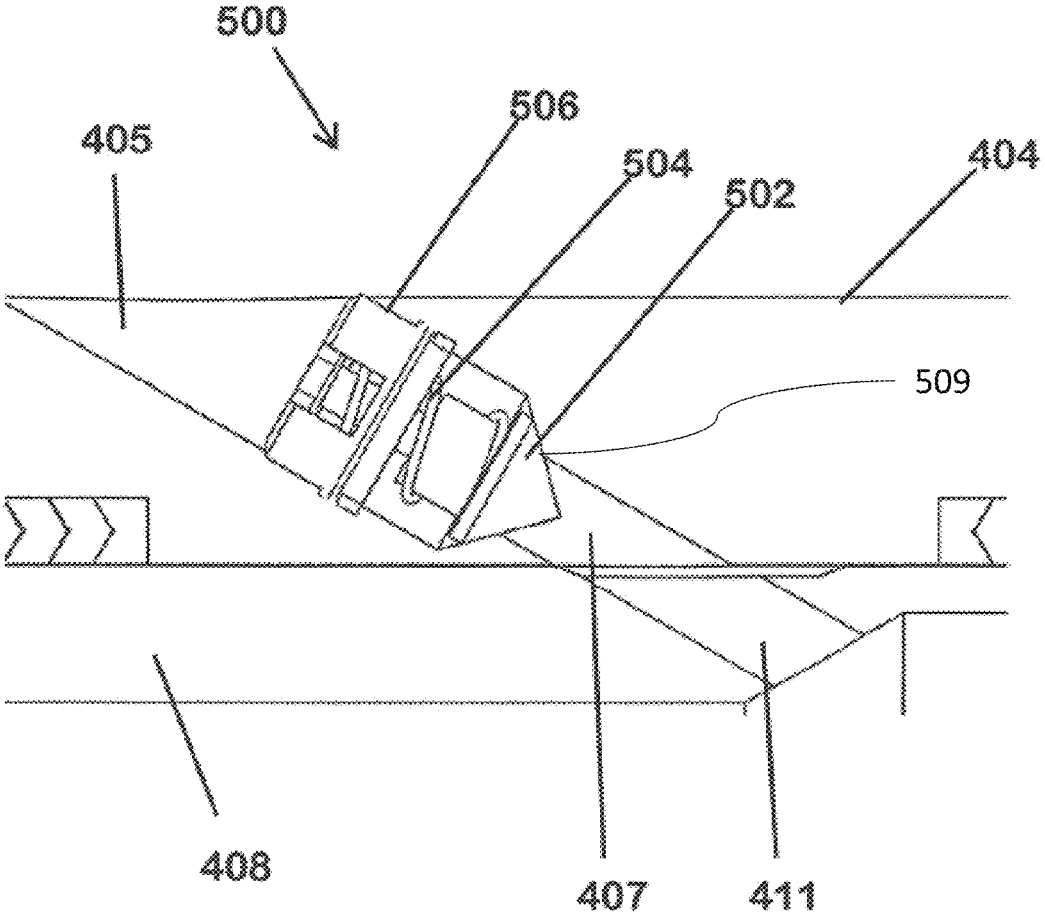

Referring now to FIG. 9, embodiments for use with the present retrievable ESP system are illustrated for isolating the reservoir once an isolation sleeve 300 is installed. Downhole isolation valve 600 is disposed below WCM 202, and may comprise a ball valve or similar fluid flow control valve configuration. The actuation of isolation valve 600 may be used to isolate the reservoir and prevent fluid flow from the tubing when the inner completion is removed for well workover or other service. In some embodiments, isolation valve 600 may be actuated mechanically or hydraulically as the inner completion string is retrieved from the ESP system. Alternatively, or in combination, isolation valve 600 may be actuated electrically, taking advantage of the nearby power source provided by the power cable 30 using an extension 32. Additionally, isolation valve 600 may be actuated mechanically or hydraulically upon the deployment of isolation sleeve 300 after the inner completion string is removed. Moreover, additional components such as a packer 700 or gas venting sliding sleeve 400 (or standard sliding sleeve, not shown), could be electrically powered using the same power source 30 through additional extension leads 32.

While preferred embodiments of this disclosure have been shown and described, modifications thereof can be made by one skilled in the art without departing from the scope or teaching herein. The embodiments described herein are exemplary only and are not limiting. Because many varying and different embodiments may be made within the scope of the present inventive concept, including equivalent structures, materials, or methods hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A downhole electrical wet connect mandrel, for use in a production tubing-mounted downhole permanent completion, comprising:

a. a wet connect tubular member having an upper connection end and a lower connection end, an outer surface, and an internal bore of a desired internal diameter, the upper and lower wet connect tubular connection ends being connectable to ends of the production tubing to permit axial mounting of the wet connect tubular member as a section of the production tubing in the permanent completion;

b. an inlet section located on the wet connect tubular member, the inlet section comprising a zone of one or more perforations through the tubular member, the zone having an upper zone end and a lower zone end, the inlet section capable of permitting the passage of fluid therethrough;

c. an electrical wet connect located on the wet connect tubular proximate the upper connection end or lower connection end, the electrical wet connect capable of receiving a source of power from a surface power cable extending downhole outside of the production tubing, the electrical wet connect capable of interfacing with a downhole device requiring power that is located proximate the wet connect to supply power to the device;

d. an inner concentric sleeve bore along a length of the internal bore of the mandrel that includes the inlet section, the concentric sleeve bore having an upper shoulder stop and a lower shoulder stop; and e. an actuatable sliding sleeve capable of moving between a first, closed position forming a seal over the inlet section to prevent passage of fluid through the one or more perforations, and a second, open position permitting passage of fluid through the one or more perforations, wherein the actuatable sliding sleeve further comprises:

i. a tubular sleeve segment located within the concentric sleeve bore and having an outer surface in sliding arrangement with the concentric sleeve bore, an upper end and a lower end defining a length sufficient to cover the one or more perforations within the inlet section;

ii. an upper concentric seal located on the outer surface proximate the upper end of the sleeve;

iii. a lower concentric seal located on the outer surface proximate the lower end of the sleeve;

wherein the sliding sleeve is capable of being moved within the concentric sleeve bore between the upper and lower stops;

wherein when the sliding sleeve is in its open position, the sleeve seals are located within the concentric sleeve bore below the inlet perforation zone to permit passage of fluid through the inlet; and wherein when the sliding sleeve is in its closed position, the inlet perforation zone is located between the upper and lower sleeve seals to form a seal over the inlet section to prevent passage of fluid through the inlet; and wherein the diameter of the internal bore of the wet connect tubular member is sufficient to permit the passage of a retrievable ESP tool or other downhole tool therethrough or within.

2. The downhole electrical wet connect mandrel of claim 1 wherein the sliding sleeve is adapted to be actuated mechanically, electrically or hydraulically.

3. The downhole electrical wet connect mandrel of claim 1 wherein the sliding sleeve is adapted to be actuated electrically using power supplied by the surface power cable.

4. The downhole electrical wet connect mandrel of claim 1 wherein the sliding sleeve is adapted to be actuated electrically using power supplied by the electrical wet connect.

* * * * *